US005663026A

United States Patent [19]

Kasuya et al.

[11] Patent Number: 5,663,026

[45] Date of Patent: Sep. 2, 1997

[54] MAGNETIC TONER, PROCESS CARTRIDGE AND IMAGE FORMING METHOD

[75] Inventors: Takashige Kasuya, Sohka; Hiroyuki Suematsu; Koichi Tomiyama, both of Yokohama; Hiroshi Yusa, Machida; Takakuni Kobori, Kawasaki; Masaichiro Katada, Yokohama, all of Japan

[73] Assignee: Canon Kabushiki Kaisha, Tokyo, Japan

[21] Appl. No.: 619,873

[22] Filed: Mar. 20, 1996

Related U.S. Application Data

[63] Continuation of Ser. No. 534,922, Sep. 28, 1995, abandoned, which is a continuation of Ser. No. 321,040, Oct. 6, 1994, abandoned.

[30] Foreign Application Priority Data

Oct. 8, 1993 [JP] Japan ..... 5-275928

[51] Int. Cl.[6] ..... G03G 9/09; G03G 9/083; G03G 15/09

[52] U.S. Cl. ..... 430/106; 430/106.6; 430/110; 430/111; 399/252

[58] Field of Search ..... 430/106, 106.6, 430/110, 111

[56] References Cited

U.S. PATENT DOCUMENTS

| | | | |
|---|---|---|---|
| 2,221,776 | 11/1940 | Carlson . | |
| 2,297,691 | 10/1942 | Carlson . | |
| 2,618,552 | 11/1952 | Wise . | |
| 2,874,063 | 2/1959 | Greig . | |
| 3,666,363 | 5/1972 | Tanaka et al. . | |
| 3,909,258 | 9/1975 | Kotz . | |
| 4,071,361 | 1/1978 | Marushima . | |
| 4,395,476 | 7/1983 | Kanbe et al. | 430/102 |
| 4,820,603 | 4/1989 | Sakashita | 430/106.6 |
| 4,975,214 | 12/1990 | Sakashita et al. | 252/62.59 |
| 5,137,796 | 8/1992 | Takiguchi et al. | 430/106.6 |

FOREIGN PATENT DOCUMENTS

| | | | |
|---|---|---|---|
| 0187434 | 7/1986 | European Pat. Off. . | |
| 0468525 | 1/1992 | European Pat. Off. . | |
| 55-18656 | 2/1980 | Japan . | |
| 61-34070 | 2/1986 | Japan . | |
| 62-278131 | 12/1987 | | |
| 62-279352 | 12/1987 | Japan . | Japan . |
| 5-213620 | 8/1993 | Japan . | |
| 0533069 | 3/1993 | WIPO . | |

*Primary Examiner*—Roland Martin
*Attorney, Agent, or Firm*—Fitzpatrick, Cella, Harper & Scinto

[57] ABSTRACT

A magnetic toner is formed from a binder resin and silicon-containing magnetic iron oxide particles. The magnetic toner has a weight-average particle size of at most 13.5 μm, and the magnetic toner has a particle size distribution such that magnetic toner particles having a particle size of at least 12.7 μm are contained in an amount of at most 50 wt. %. The magnetic iron oxide particles have a silicon content of 0.4–2.0 wt. % based on iron, and the magnetic iron oxide particles have an Fe/Si atomic ratio of 1.2–4.0 at the utmost surfaces thereof. Because of the use of such magnetic iron oxide particles having a specifically controlled overall and surface Si contents, the magnetic toner can show stable performances even after standing in a high humidity environment.

29 Claims, 4 Drawing Sheets

MAGNETIC TONER, PROCESS CARTRIDGE AND IMAGE FORMING METHOD

This application is a continuation of application Ser. No. 08/534,922, filed Sep. 28, 1995, now abandoned; which is a continuation of application Ser. No. 08/321,040, filed Oct. 6, 1994, now abandoned.

FIELD OF THE INVENTION AND RELATED ART

The present invention relates to a magnetic toner for visualizing electrostatic images in image forming methods, such as electrophotography and electrostatic recording, a process cartridge including such a magnetic toner, and an image forming method using the magnetic toner.

Hitherto, a large number of electrophotographic processes have been known, as disclosed in U.S. Pat. Nos. 2,297,691; 3,666,363; 4,071,361 and others. In these processes, an electric latent image is formed on a photosensitive member comprising a photoconductive material by various means, then the latent image is developed and visualized with a toner, and the resultant toner image is, after transferred onto a transfer material, such as paper, as desired, fixed by heating, pressing, heating and pressing, etc., to obtain a copy or a print.

Various developing methods for visualizing electrostatic latent images with toner have also been known. For example, there have been known the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; in addition, the fur brush developing method; and the liquid developing method. Among these developing methods, those developing methods using a developer composed mainly of a toner and a carrier such as the magnetic brush method, the cascade process and the liquid developing method have been widely used commercially. While these methods provide good images relatively stably, they involve common problems accompanying the use of two-component developers, such as deterioration of carriers and change in mixing ratio of the toner and carrier.

In order to obviate such problems, various developing methods using a one-component developer consisting only of a toner, have been proposed. Among these, there are many excellent developing methods using developers comprising magnetic toner particles.

U.S. Pat. No. 3,909,258 has proposed a developing method using an electroconductive magnetic toner, wherein an electroconductive magnetic toner is carried on a cylindrical electroconductive sleeve provided with a magnet inside thereof and is caused to contact an electrostatic image-bearing member having an electrostatic image to effect development. In this method, as the development zone, an electroconductive path is formed with magnetic toner particles between the recording member surface and the sleeve surface and the toner particles are attached to image portions due to a Coulomb's force exerted between the image portions and the magnetic toner particles to effect development. This method using an electroconductive magnetic toner is an excellent method which has obviated the problems involved in the two-component developing methods. However, as the toner is electroconductive, there is involved a problem that it is difficult to transfer the developed toner image electrostatically from the electrostatic image-bearing member to a final support member such as plain paper.

As a developing method using a magnetic toner with a high resistivity which can be electrostatically transferred, a developing method using a dielectric polarization of toner particles is known. Such a method, however, involves essential problems that the developing speed is slow and a sufficient density of developed image cannot be obtained.

As another method using a high resistivity magnetic toner, there are known methods wherein magnetic toner particles are triboelectrically charged through friction between magnetic toner particles or friction between a friction member such as a sleeve and magnetic toner particles, and then caused to contact an electrostatic image-bearing member to effect development. However, these methods involve problems that the triboelectric charge is liable to be insufficient because the number of friction between the magnetic toner particles and the friction member is small, and the charged toner particles are liable to agglomerate on the sleeve because of an enhanced Coulomb's force.

A developing method having eliminated the above described problems has been proposed in U.S. Pat. No. 4,395,476 (corresponding to Japanese Laid-Open Patent Application (JP-A) 55-18656). In this method (so-called "jumping developing method"), a magnetic toner is applied in a very small thickness on a sleeve, triboelectrically charged and is brought to an extreme vicinity to an electrostatic image to effect development. More specifically, in this method, an excellent image is obtained through such factors that a sufficient triboelectric charge can be obtained because a magnetic toner is applied onto a sleeve in a very small thickness to increase the opportunity of contact between the sleeve and the magnetic toner; and the magnetic toner is carried by a magnetic force, and the magnet and the toner are relatively moved to disintegrate the agglomerate of the magnetic toner particles and cause sufficient friction between the toner and the sleeve.

However, the insulating toner used in the above-mentioned developing method contains a considerable amount of fine powdery magnetic material, and a part of the magnetic material is exposed to the surface of a toner particle, so that the kind of the magnetic material affects the flowability and triboelectric chargeability of the magnetic toner, thus affecting the developing performance and successive image forming performance of the magnetic toner.

More specifically, on continuation of repetitive developing step (e.g., for copying) for a long period in the jumping developing method using a magnetic toner containing a conventional magnetic material, the flowability of a developer containing the magnetic toner is lowered to fail in providing a sufficient triboelectric charge and result in unstable charge, thus being liable to result in image defects, such as occurrence of fog, in a low temperature—low humidity environment. Further, in case of a weak adhesion between the binder resin and the magnetic material constituting magnetic toner particles, the magnetic material is liable to be lost from the surface of the magnetic toner on repetition of the developing step to result in adverse phenomena, such as a lowering in toner image density.

Further, in case where the magnetic material is ununiformly dispersed in magnetic toner particles, small magnetic toner particles containing much magnetic material can be accumulated on a developing sleeve to result in a lowering in image density or a density irregularity called "sleeve ghost" in some cases.

Several proposals have been made regarding magnetic iron oxide contained in a magnetic toner.

For example, Japanese Laid-Open Patent Application (JP-A) 62-279352 (corr. to U.S. Pat. No. 4,820,603) and JP-A 62-278131 (corr. to U.S. Pat. No. 4,975,214) have proposed a magnetic toner containing magnetic iron oxide containing silicon. Such magnetic iron oxide particles contain silicon disposed intentionally in the interior of magnetic iron oxide particles. The magnetic toner containing the magnetic iron oxide particles has left some room for improvement regarding its flowability.

Japanese Patent Publication (JP-B) 3-9045 (corr. to EP-A 187434) has proposed to control the shape of magnetic iron oxide particles to a spherical one by adding a silicic acid salt. The magnetic iron oxide particles obtained by this method contain silicon in a larger amount in their interior and in a smaller amount at their surface, so that the improvement in flowability of the magnetic toner is liable to be insufficient.

JP-A 61-34070 has proposed a process for producing triiron tetroxide wherein a hydrosilicic acid salt solution is added during oxidization to triiron tetroxide. The triiron tetroxide produced by the process contains silicon in the vicinity of the surface and the silicon is present in the form of a layer in the vicinity of the triiron tetroxide surface. As a result, the surface of the triiron tetroxide is week against a mechanical shock, such as friction.

In order to solve the above-mentioned problems, our research and development group has proposed a magnetic toner containing magnetic iron oxide particles such that the magnetic iron oxide particles contain silicon therein and 44–84% of the total silicon is present in the vicinity of the surfaces of the magnetic iron oxide particles (JP-A 5-72801, corr. to EP-A 533069).

The magnetic toner containing the magnetic iron oxide particles has shown an improved flowability and an improved adhesion between the binder resin and the magnetic iron oxide particles. The magnetic toner has resulted in a problem of inferior environmental characteristic, particularly a deterioration in chargeability when left standing in a high humidity. environment, because of the localizaion of Si at the surface and the porous structure at the surface resulting in an increase in BET specific surface area of the magnetic iron oxide particles.

Further, JP-A 4-362954 (corr. to EP-A 468525) has disclosed magnetic iron oxide particles containing both silicon and aluminum. JP-A 5-213620 has disclosed magnetic iron oxide particles wherein a siliceous component is contained and exposed to the surface thereof. However, further improved environmental characteristics are still desired.

In recent years, diversities of performances are required of image forming apparatus using electrophotography, such as copying machines and laser beam printers, and it has been required to provide resultant toner images showing a high resolution and high image qualities. A toner and a process cartridge filled with such a toner can be stored in various environment, so that a storage stability is an important property required of such a toner.

SUMMARY OF THE INVENTION

An object of the present invention is to provide a magnetic toner having solved the above-mentioned problems.

A more specific object of the present invention is to provide a magnetic toner providing high-density images and showing excellent developing characteristics.

Another object of the present invention is to provide a magnetic toner capable of providing fog-free images and exhibiting stable chargeability even in a long term use.

A further object of the present invention is to provide a magnetic toner showing excellent chargeability and excellent long-term storage stability even in a high-humidity environment.

A still further object of the present invention is to provide a process cartridge including such a magnetic toner, and an image forming method using such a magnetic toner.

According to the present invention, there is provided a magnetic toner, comprising magnetic toner particles containing a binder resin and magnetic iron oxide particles; wherein the magnetic toner has a weight-average particle size of at most 13.5 μm, the magnetic toner has a particle size distribution such that magnetic toner particles having a particle size of at least 12.7 μm are contained in an amount of at most 50 wt. %, the magnetic iron oxide particles have a silicon content of 0.4–2.0 wt. % based on iron, and the magnetic iron oxide particles have an Fe/Si atomic ratio of 1.2–4.0 at the utmost surfaces thereof.

According to another aspect of the present invention, there is provided a process cartridge, comprising at least a developing means and a photosensitive member; wherein said developing means and photosensitive member are integrated into a cartridge disposed detachably attachable to an apparatus main assembly, and said developing means includes a magnetic toner as described above.

According to still another aspect of the present invention, there is provided an image forming method, comprising:

forming an electrostatic image on an electrostatic image-bearing member, and developing the electrostatic image with a magnetic toner as described above held in a developing means to form a toner image on the electrostatic image-bearing member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
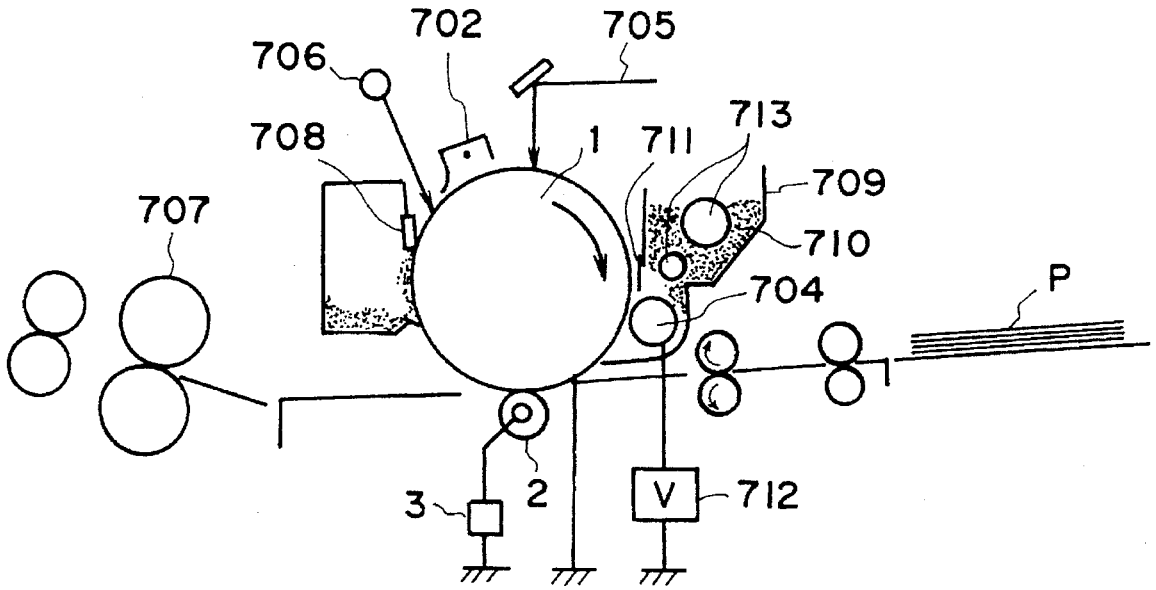
FIG. 1 is a schematic illustration of an example of an image forming apparatus suitable for image formation by using a magnetic toner according to the invention.

A toner is required of an increased durability accompanying a higher process speed and an increased number of successively produced image sheets in an image forming apparatus, such as a printer.

We have found it possible to obtain a magnetic toner containing magnetic iron oxide particles exhibiting excellent physical properties and performances, inclusive of excellent flowability, excellent long-term storage stability, successive image forming characteristics and uniform dispersibility of the magnetic iron oxide particles in the magnetic toner particles by controlling the utmost surface state, composition and structure of the magnetic iron oxide particles.

A characteristic feature of the magnetic toner according to the present invention is that it has a weight-average particle size of at most 13.5 μm (preferably 3.5–13.5 μm, more preferably 4.0–11.0 μm), has a particle size distribution such that the magnetic toner particles having a particle size of at least 12.7 μm occupy at most 50 wt. % (preferably at most 40 wt. %, more preferably at most 30 wt. %), and contains a specific silicon-containing magnetic iron oxide.

In case of a magnetic toner containing a large amount of relatively coarse particles, such as one having a weight-average particle size exceeding 13.5 μm or one containing more than 50 wt. % of magnetic toner particles having a particle size of at least 12.7 μm, the magnetic toner is caused to show a lower resolution and is liable to cause fog.

In case of magnetic toner particles having a weight-average particle size of below 3.5 μm, the flowability of the magnetic toner is lowered and problems, such as fog or insufficient density, due to insufficient charge, are liable to be caused, even if the specific magnetic iron oxide particles are used. Therefore, the weight-average particle size should preferably be at least 3.5 μm.

Another characteristic feature of the magnetic toner according to the present invention is that the magnetic iron oxide particles therein contain silicon (Si) at a content of 0.4–2.0 wt. % (preferably 0.5–0.9 wt. %) based on the total iron (Fe) content therein, and an Fe/Si atomic ratio of 1.2–4.0 at the utmost surfaces thereof. The Fe/Si atomic ratio at the utmost surfaces of magnetic iron oxide particles may be measured by X-ray photoelectron spectroscopy (XPS).

In case where the silicon content is below 0.4 wt. % or the Fe/Si atomic ratio exceeds 4.0, the improving effect (particularly in respect of flowability) for the magnetic toner becomes insufficient. In case where the silicon content is above 2.0 wt. % or the Fe/Si atomic ratio is below 1.2, there result in a deterioration in environmental characteristic, particularly the chargeability after a long term standing in a high-humidity environment, and also a lower successive image forming characteristic and an inferior dispersibility of magnetic iron oxide particles in the binder resin.

The amount of silicon at the utmost surfaces of the magnetic iron oxide particles has a correlation with the flowability and the hygroscopicity of the magnetic iron oxide particles, and remarkably affects the properties of the magnetic toner containing magnetic iron oxide particles.

In a preferred embodiment of the present invention, the magnetic iron oxide particles may have a smoothness of 0.3–0.8, preferably 0.45–0.7, more preferably 0.5–0.7. The smoothness has a correlation with the amount of pores at the surfaces of the magnetic iron oxide particles. A smoothness below 0.3 means the presence of many pores at the surfaces of the magnetic iron oxide particles, thus promoting the moisture adsorption.

In a preferred embodiment of the present invention, the magnetic iron oxide particles may have a bulk density of at least 0.8 g/cm$^3$ preferably at least 1.0 g/cm$^3$.

In case where the magnetic iron oxide particles have a bulk density below 0.8 g/cm$^3$, the physical mixability thereof with the other toner ingredients can be adversely affected, thereby resulting in inferior dispersibility of the magnetic iron oxide particles.

In a preferred embodiment of the present invention, the magnetic iron oxide particles may have a BET specific surface of at most 15.0 m$^2$/g, preferably at most 12.0 g/m$^2$. In case where the magnetic iron oxide particles have a BET specific surface area exceeding 15.0 m$^2$/g, the magnetic iron oxide particles can have an increased hygroscopicity so as to adversely affect the moisture-absorptivity and chargeability of the magnetic toner containing the magnetic iron oxide particles.

As a result of extensive study, we have found that the hygroscopicity of magnetic iron oxide particles is related with their surface pores, and the control of the pore volume may be a most important factor. It is preferred that the magnetic iron oxide particles have a pore volume of $7.0\times10^{-3}$–$15.0\times10^{-3}$ ml/g, more preferably $8.0\times10^{-3}$–$12.0\times10^{-3}$ ml/g, at their surfaces.

If the total surface pore volume is below $7.0\times10^{-3}$ ml/g, the magnetic iron oxide particles can have a remarkably lower moisture retentivity, so that the toner containing the magnetic iron oxide particles is liable to cause a charge-up and a lower image density in a low-humidity environment.

If the total surface pore volume exceeds $15.0\times10^{-3}$ ml/g, the magnetic iron oxide particles are caused to have an increased hygroscopicity. As a result, the magnetic toner containing the magnetic iron oxide particles, when left standing in a high-humidity environment, is liable to cause moisture absorption to have a lower chargeability, thus providing a lower image density.

The magnetic iron oxide particles used in the present invention may preferably have a surface pore distribution such that micro-pores having a pore diameter smaller than 20 Å provide a total specific surface area which is equal to or smaller than that of meso-pores having a pore diameter of at least 20 Å (20 Å–500 Å).

The surface pore diameter of the magnetic iron oxide particles greatly affects the moisture-absorptivity. Small pores do not readily cause desorption of adsorbed water. In case where the micro-pores having a pore diameter smaller than 20 Å provide a total (specific) surface area exceeding that of the meso-pores having a pore diameter of at least 20 Å, there are present many adsorption sites from which adsorbed moisture is not readily desorbed, so that the magnetic toner containing the magnetic iron oxide particles is liable to cause a lowering in chargeability, particularly when left for a long term in a high-humidity environment, and the chargeability cannot be readily recovered.

It is further preferred that the magnetic iron oxide particles used in the present invention may preferably be free from a substantial hysteresis between nitrogen adsorption and desorption isotherms, i.e., a difference in adsorbed gas quantity of at most 4% between those on the adsorption and desorption isotherms at an arbitrary relative pressure.

The presence of a hysteresis (i.e., a difference in adsorbed gas amount) on the nitrogen adsorption-desorption isotherms means the presence of ink bottle-shaped pores having a narrow inlet diameter and a wider interior diameter, so that the adsorbed substance (moisture or nitrogen) is not readily desorbed, and the magnetic toner containing the magnetic iron oxide particles is caused to have a chargeability which is adversely affected particularly in a high-humidity environment.

It is further preferred that the magnetic iron oxide particles have such a hygroscopicity characteristic as to show a moisture content of 0.4–1.0 wt. % (more preferably 0.45–0.90 wt. %) at a temperature of 23.5° C. and a humidity of 65% RH, and a moisture content of 0.6–1.5 wt. % (more preferably 0.60–1.10 wt. %) at a temperature of 32.5° C. and a humidity of 85% RH, the moisture contents providing a difference therebetween not exceeding 0.6 wt. % (more preferably not exceeding 0.3 wt. %).

If the moisture contents are lower than the above-mentioned ranges, the resultant magnetic toner is liable to cause a charge-up particularly in a low-humidity environment. If the moisture contents are above the above-mentioned ranges, the chargeability is liable to be lowered. Further, the difference in moisture content between the respective environments exceeds 0.6 wt. %, an undesirable change in image forming characteristic can be caused by a change in environmental conditions.

It is further preferred that the magnetic iron oxide particles used in the present invention have been treated with aluminum hydroxide in an amount of 0.01–2.0 wt. % (more preferably 0.05–1.0 wt. %) calculated as aluminum based on the weight of the magnetic iron oxide.

While the reason has not been fully clarified as yet, it has been confirmed that the magnetic iron hydroxide particles surface-treated with aluminum oxide provide a magnetic toner having a stabilized chargeability. However, if the treating amount is below 0.01 wt. % (as aluminum), the effect is scarce but, if the amount exceeds 2.0 wt. %, the resultant magnetic toner can be adversely affected with respect to environmental characteristics, particularly the chargeability in a high-humidity environment.

It is further preferred that the magnetic iron oxide particles have an Fe/Al atomic ratio of 0.3–10.0 (more preferably 0.3–5.0, further preferably 0.3–2.0) at the utmost surfaces thereof. If the Fe/Al atomic ratio is below 0.3, the resultant magnetic toner is liable to have inferior environmental characteristics, particularly chargeability in a high-humidity environment and, if the Fe/Al atomic ratio exceeds 10.0, the charge stabilization effect is scarce.

The magnetic iron oxide particles used in the present invention may preferably have an average particle size of 0.1–0.4 μm, more preferably 0.1–0.3 μm.

Various physical parameters characterizing the present invention may be measured according to the following methods.

(1) Particle Size Distribution of a Magnetic Toner

The particle size distribution of a magnetic toner is measured by means of a Coulter counter in the present invention, while it may be measured in various manners.

Coulter counter Model TA-II (available from Coulter Electronics Inc.) may be used as an instrument for measurement.

For measurement, a 1%-NaCl aqueous solution as an electrolytic solution may be prepared by using a reagent-grade sodium chloride. As a commercially available example, it is possible to use "ISOTON (R)-II" (available from Coulter Scientific Japan K. K.). Into 100 to 150 ml of the electrolytic solution, 0.1 to 5 ml of a surfactant, preferably an alkylbenzene-sulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 μm by using the above-mentioned Coulter counter Model TA-II with a 100 μm-aperture to obtain a volume-basis distribution and a number-basis distribution. From the results of the volume-basis distribution and number-basis distribution, parameters characterizing the magnetic toner of the present invention may be obtained. More specifically, the weight-basis average particle size $D_4$ may be obtained from the volume-basis distribution while a central value in each channel is taken as a representative value for each channel. Similarly, it is possible to obtain a number-average particle size (D1) from the number-basis distribution, an amount of course particles (≧12.7 μm) from the volume-basis distribution, and an amount of fine particles (≦6.35 μm) from the number-basis distribution.

(2) Fe/Si Atomic Ratio, Fe/Al Atomic Ratio

The Fe/Si atomic ratio and the Fe/Al atomic ratio at the utmost or very surfaces of magnetic iron oxide particles referred to herein are based on values measured by XPS (X-ray Photoelectron Spectroscopy). The conditions are as follows.

Apparatus: "ESCALAB Model 200-X" (available from VG Co.)

X-ray source: Mg Kα (300 W)

Analyzed region: 2×3 mm (3) Bulk Density

The bulk densities of magnetic iron oxide particles referred to herein are based on values measured according to JIS K5101 (pigment test method).

(4) Smoothness

The smoothness D of magnetic iron oxide particles may be defined as follows:

Smoothness D=[Surface area ($m^2/g$) of magnetic iron oxide calculated from the average particle size]/[Measured BET specific surface area ($m^2/g$) of magnetic iron oxide].

(5) BET Specific Surface Area

The BET specific surface area of magnetic iron oxide may be measured by using a full-automatic gas adsorption tester ("Autosorb 1", mfd. by Yuasa Ionix K. K.) and nitrogen as an adsorption gas according to the BET multi-points method. The sample is subjected to evacuation for 10 hours at 50° C. as a pre-treatment.

(6) Average Diameter and Surface Area of Magnetic Iron Oxide Particles

The values referred to herein are based on the following method.

Sample magnetic iron oxide particles are photographed through a transmission electron microscope to obtain enlarged projection pictures at a magnification of $4\times10^4$. From the pictures, 250 particles are taken at random and the Martin diameter (a diameter in a fixed direction that divides a projected area into equal halves) is measured for each particle. The number-average value of Martin diameters of 250 particles is taken as an average particle size (Dav).

For the surface area calculation, the density of sample magnetic iron oxide particles is measured in an ordinary method, and the surface area of the sample is calculated according to the following equation based on an assumption that each magnetic iron oxide particle has a shape of sphere having the measured average particle size (Dav).

[Surface area]=6/[(density)×Dav.]

(7) Pore Distribution

The adsorption-desorption isotherms, total pore volume, and total specific surface areas of micro-pores having a pore diameter below 20 Å and meso-pores having a pore diameter of at least 20 Å of magnetic iron oxide particles referred to herein are values measured in the following manner.

A full-automatic gas adsorption tester ("Autosorb 1", mfd. by Yuasa Ionix K. K.) is operated by using nitrogen as an adsorption gas. The measurement is performed by taking 40 points each for the adsorption and desorption within a relative pressure range of 0–1.0. The pore diameter distribution is obtained based on the t-plot method of de Boer, Kelvin formula and B.J.H. method. Each sample is subjected to evacuation for 10 hours at 50° C. as a pre-treatment.

(8) Moisture Content

The moisture contents of magnetic iron oxide particles referred to herein are based on values measured in the following manner. Magnetic iron oxide particles are placed separately in an environment of temperature 23.5° C. and humidity 65% R.H. and an environment of temperature 32.5° C. and humidity 85% R.H. and respectively left standing therein for 3 days. The moisture contents of the magnetic iron oxide samples are measured by a micro-quantity moisture tester ("Model AQ-6", available from Hiranuma Sangyo K. K.) and an auto-moisture gassifier ("Model SE-24", ditto) and heating each sample at 130° C. while passing carrier nitrogen at a rate of 0.2 liter/min.

(9) Silicon Content

The silicon contents of magnetic iron oxide particles referred to herein are based on values measured by subjecting a powdery sample to fluorescent X-ray analysis by using a fluorescent X-ray analyzer ("SYSTEM 3080", mfd. by Rigaku Denki Kogyo K. K.) according to JIS K0119 ("general rules of fluorescent X-ray analysis").

The magnetic toner according to the present invention may preferably contain the magnetic iron oxide in an amount of 20–200 wt. parts, further preferably 30–150 wt. parts, per 100 wt. parts of the binder resin.

As desired, the magnetic iron oxide particles can be treated with silane coupling agent, titanate coupling agent, aminosilanes, organic silicon compounds, etc.

Examples of the silane coupling agent used for surface-treatment of the magnetic iron oxide particles may include: hexamethyldisilazane, trimethylsilane, trimethylchlorosilane, trimethyl-ethoxysilane, dimethyldichlorisilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane chloromethyl-dimethylchlorosilane, triorganosilanemercaptan, trimethylsilyl-mercaptan, triorganosilyl acrylate, vinyldimethyl-acetoxysilane, dimethylethoxysilane, dimethyl-dimethoxysilane, diphenyldiethoxysilane, hexamethyldisiloxane, 1,3-divinyltetramethyl-disiloxane, and 1,3-diphenyltetramethyldisiloxane.

Examples of the titanate coupling agent may include: isopropoxytitanium triisostearate, isopropoxytitanium dimethacrylate isostearate, isopropoxytitanium tridecylbenzenesulfonate, isopropoxytitanium trisdioctylphosphate, isopropoxytitanium-tri-N-ethylaminoethylaminate, titanium bisdioctylpyrophosphate oxyacetate, titanium bisdioctylphoosphate ethylenedioctylphosphite, and di-n-butoxybistriethanolaminatotitanium.

The organic silicon compound may for example be silicone oil. The silicone oil may preferably have a viscosity at 25° C. of about 30–1,000 centi-stokes and may preferably include, for example, dimethylsilicone oil, methylphenyl-silicone oil, α-methylstyrene-modified silicone oil, chlorophenylsilicone oil, and fluorinated silicone oil.

Examples of the binder resin constituting the toner according to the present invention may include: polystyrene; homopolymers of styrene derivatives, such as polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymers; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resin, aromatic petroleum resin, paraffin wax, and carnauba wax. These resins may be used alone or in mixture. Particularly, styrene copolymers and polyester resins may be preferred in view of developing and fixing performances.

In the toner according to the present invention, it is also possible to use hydrocarbon wax or ethylenic olefin polymers, as a fixing aid, in combination with the binder resin.

Examples of such ethylenic olefin homopolymers or copolymers may include: polyethylene, polypropylene, ethylene-propylene copolymer, ethylenevinyl acetate copolymer, ethylene-ethyl acrylate copolymer, and ionomers having polyethylene skeletons. Among the copolymers, those including olefin monomer units in a proportion of at least 50 mol. %, particularly at least 60 mol. %, may be preferred.

The magnetic toner according to the present invention can further contain a colorant, examples of which may include known pigments or dyes, such as carbon black and copper-phthalocyanine.

The magnetic toner according to the present invention can contain a charge control agent. For a negatively chargeable toner, it is possible to use a negative charge control agent, such as metal complex salts of monoazo dyes, and metal complex salts of salicylic acid, alkylsalicylic acid, dialkyl-salicylic acid or naphthoic acid.

Further, for a positively chargeable toner, it is possible to use a positive charge control agent, such as nigrosine compounds and organic quaternary ammonium salts.

Examples of the negative charge control agent may include compounds represented by the following formulae.

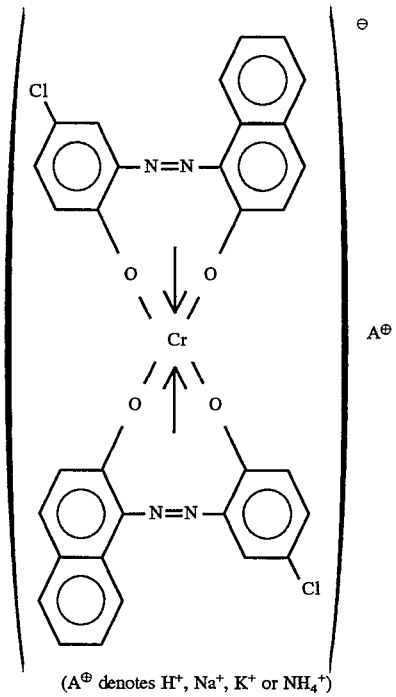
(A⊕ denotes $H^+$, $Na^+$, $K^+$ or $NH_4^+$)
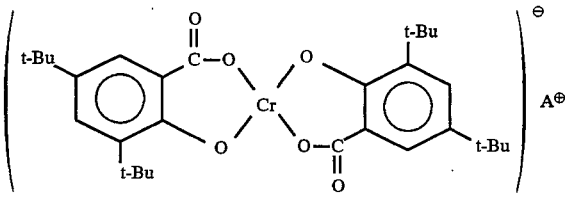
(t-Bu denotes a t-butyl group)
-continued
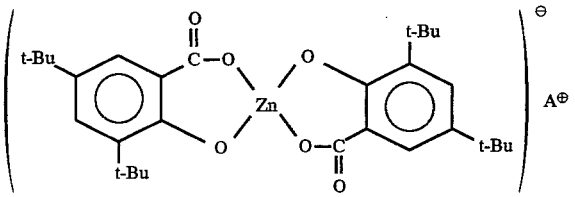
The following three types of negative charge control agents may be preferred as effective for combination with the magnetic iron oxide particles used in the present invention.
1) Monoazo iron complex salts
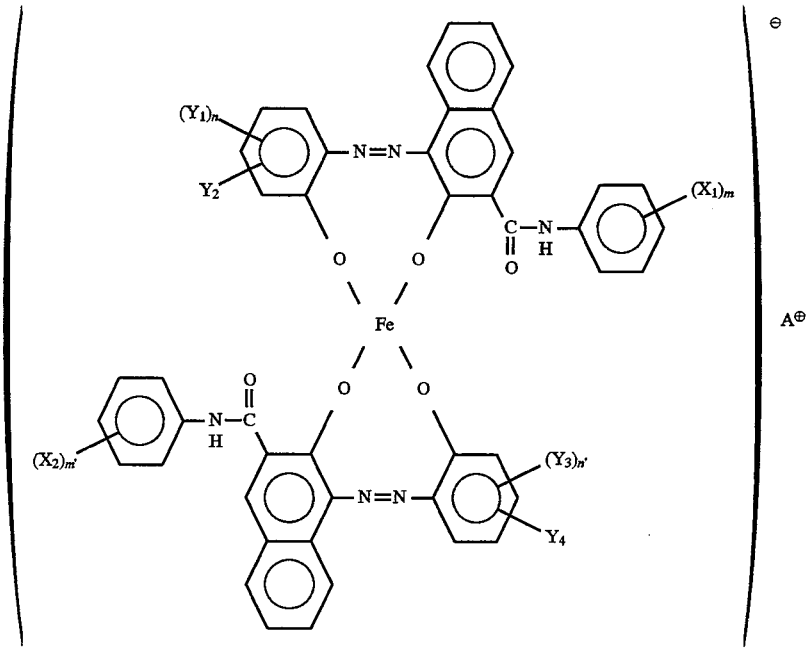

wherein $X_1$ and $X_2$ independently denote hydrogen, lower alkyl, lower alkoxy, nitro or halogen;

m and m' independently denote an integer of 1–3;

$Y_1$ and $Y_3$ independently denote hydrogen, $C_1$–$C_{18}$ alkyl, $C_2$–$C_{18}$ alkenyl, sulfonamide, mesyl, sulfonic acid, carboxy ester, hydroxy, $C_1$–$C_{18}$ alkoxy, $C_2$–$C_{18}$ acetylamino, benzoyl, amino or halogen;

n and n' independently denote an integer of 1–3;

$Y_2$ and $Y_4$ independently denote hydrogen or nitro;

$A^{\oplus}$ denotes $H^+$, $Na^+$, $K^+$ or $NH_4^+$.

2) Iron complexes with aromatic hydroxycarboxylic acid, aromatic diol or aromatic dicarboxylic acid derivative represented by the following formula:

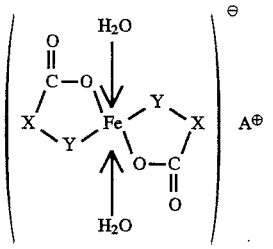

wherein X denotes

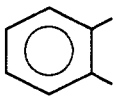

capable of having a substituent, such as alkyl,

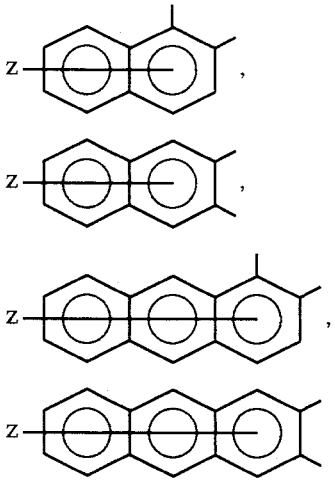

(Z; hydrogen, halogen or nitro)

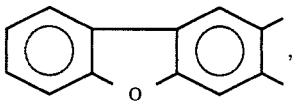

-continued

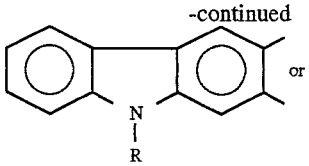

or

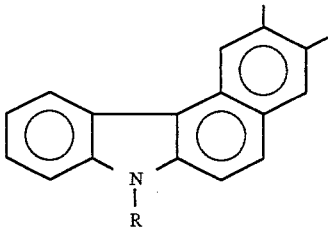

(R denotes hydrogen, $C_1$–$C_{18}$ alkyl or alkenyl)

Y denotes —O— or

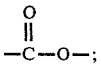

$A^{\oplus}$ denotes $H^+$, $Na^+$, $NH_4^+$ or aliphatic ammonium.

3) N,N'-bisarylurea derivative represented by the following formula:

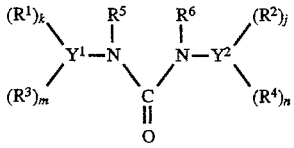

wherein $Y_1$ and $Y_2$ independently denote phenyl, naphthyl or anthryl;

$R_1$ and $R_2$ independently denote halogen, nitro, sulfonic acid, carboxyl, carboxylate, cyano, carbonyl, alkyl, alkoxy or amino;

$R_3$ and $R_3$ independently denote hydrogen, alkyl, alkoxy, phenyl capable of having a substituent, aralkyl capable of having a substituent, or amino;

$R_5$ and $R_6$ independently denote hydrogen or $C_1$–$C_8$ hydrocarbon group, k and j are independently an integer of 0–3 with the proviso that both cannot be 0; and m and n are independently 1 or 2.

While the reason has not been clarified as yet, it has been confirmed that a magnetic toner containing the magnetic iron oxide particles used in the present invention in combination with any one of the above-described three types of negative charge control agents, provides images with improved image qualities, particularly less fog.

Specific examples of the positive charge control agent may include compounds represented by the following formulae.

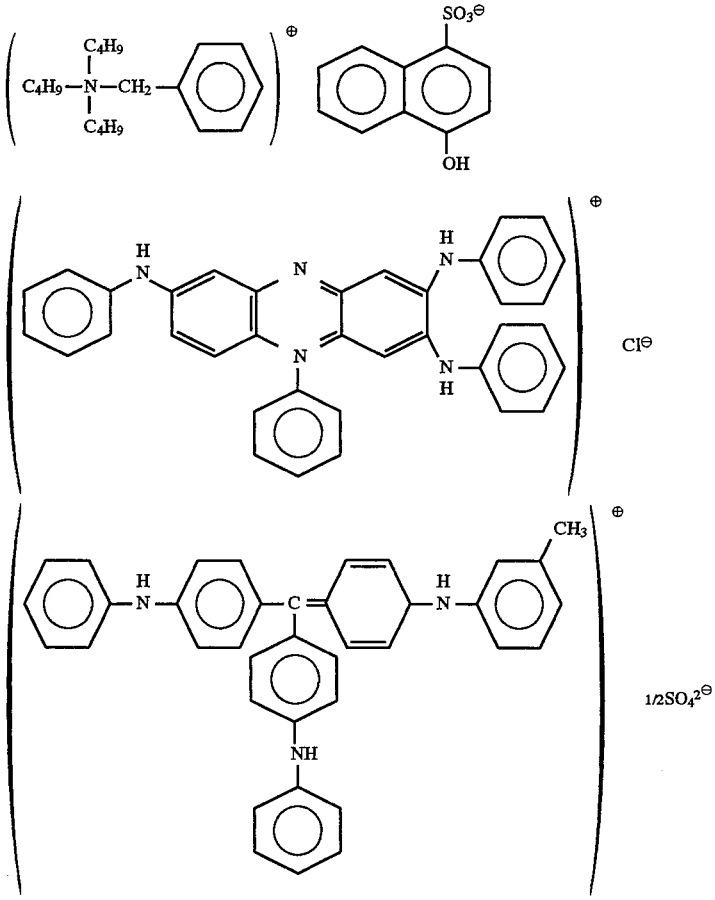

The magnetic toner according to the present invention may preferably be mixed with inorganic fine powder or hydrophobic inorganic fine powder, e.g., silica fine powder and titanium oxide fine powder alone or in combination.

The silica fine powder used in the present invention can be either the so-called "dry process silica" or "fumed silica" which can be obtained by oxidation of gaseous silicon halide, or the so-called "wet process silica" which can be produced from water glass, etc. Among these, the dry process silica is preferred to the wet process silica because the amount of the silanol group present on the surfaces or in interior of the particles is small and it is free from production residue.

It is preferred that the silica fine powder has been subjected to a hydrophobicity-imparting treatment. For the hydrophobicity-imparting treatment, the silica fine powder may be chemically treated with, e.g., an organic silicon compound which reacts with or is physically adsorbed by the silica fine powder. A preferred method includes steps of treating dry-process silica fine powder produced by vapor-phase oxidation of silicon halide with a silane coupling agent and, simultaneously therewith or thereafter, treating the silica fine powder with an organic silicon compound, such as silicone oil.

Examples of the silane coupling agent used for the hydrophobicity imparting treatment of the silica fine powder may include: hexamethyldisilazane, trimethylsilane, trimethylchlorosilane, trimethylethoxysilane, dimethyldichlorisilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilanemercaptan, trimethylsilyl-mercaptan, triorganosilyl acrylate, vinyldimethyl-acetoxysilane, dimethylethoxysilane, dimethyl-dimethoxysilane, diphenyldiethoxysilane, hexamethyldisiloxane, 1,3-divinyltetramethyldisiloxane, and 1,3-diphenyltetramethyldisiloxane.

The organic silicon compound may for example be silicone oil. The silicone oil may preferably have a viscosity at 25° C. of about 30–1,000 centi-stokes and may preferably include, for example, dimethylsilicone oil, methylphenylsilicone oil, α-methylstyrene-modified silicone oil, chlorophenylsilicone oil, and fluorinated silicone oil.

The treatment with silicone oil may be performed, e.g., by directly mixing the silica fine powder treated with silane coupling agent with silicone oil by a mixer such as a Henschel mixer, by spraying silicone oil onto the silica fine powder, or by mixing a solution or dispersion of silicone oil in an appropriate solvent with the silica fine powder, followed by removal of the solvent.

It is preferred that silica fine powder is treated with dimethyldichlorosilane, then with hexamethyldisilazane and then with silicone oil. In this way, it is preferred that silica fine powder is first treated with at least two silane coupling agents and then with an oil, in order to provide an effectively increased hydrophobicity.

The above-mentioned hydrophobicity-imparting treatment or silica fine powder may be equally applicable also to titanium oxide fine powder, and the treated titanium oxide fine powder may be equally preferably used in the present invention.

An external additive other than silica or titanium oxide fine powder may be added, as desired, to the magnetic toner according to the present invention.

Examples of such an external additive may include resin fine particles and inorganic fine particles functioning as a chargeability improver, an electroconductivity-imparting agent, a flowability improver, an anti-caking agent, a release agent at the time of hot roller fixation, a lubricant, an abrasive, etc.

Such resin fine particles may preferably have an average particle size of 0.03–1.0 μm. Such resin fine particles may be constituted by polymerization of a monomer, examples of which may include: styrene monomers, such as styrene, o-methylstyrene, m-methylstyrene, p-methylstyrene, p-methoxystyrene, and p-ethylstyrene; unsaturated acids, such as acrylic acid and methacrylic acid; acrylates, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylates, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile, and acrylamide.

The polymerization may be performed according to suspension polymerization, emulsion polymerization, soap-free polymerization, etc. It is particularly preferred to use resin fine particles obtained through soap-free polymerization. The resin fine particles may preferably be added in an amount of 0.005–5 wt. parts, more preferably 0.01–2 wt. parts, per 100 wt. parts of the magnetic toner particles.

The resin fine particles having the above-mentioned characteristic have been confirmed to exhibit a remarkable effect of preventing toner sticking onto a photosensitive member in a system using a contact charger in the form of a roller, a brush, a blade, etc., as a primary charger.

Examples of other additives may include: lubricants, such as polytetrafluoroethylene, zinc stearate, and polyvinylidene fluoride, of which polyvinylidene fluoride is particularly preferred; abrasives, such as cerium oxide, silicon carbide, and strontium titanate, of which strontium titanate is particularly preferred; flowability-improvers, such as titanium oxide and aluminum oxide, which may have preferably been hydrophobicity-imparted; anticaking agents; electroconductivity-imparting agents, such as carbon black, zinc oxide, antimony oxide, and tin oxide. It is also possible to add white and black fine particles having a chargeability to a polarity opposite to that of the toner particles, as a developing characteristic-improving agent.

The inorganic fine powder or hydrophobic inorganic fine powder to be mixed with the magnetic toner may preferably be added in a proportion of 0.1–5 wt. parts, more preferably 0.1–3 wt. parts, per 100 wt. parts of the magnetic toner particles.

The magnetic toner according to the present invention may be produced by sufficiently mixing the magnetic iron oxide particles with a thermoplastic binder resin, like those enumerated hereinbefore, and optionally, a pigment or dye as colorant, a charge controller, another additive, etc., by means of a mixer such as a ball mill, etc.; then melting and kneading the mixture by hot kneading means such as hot rollers, kneader and extruder to disperse or dissolve the magnetic iron oxide particles and the pigment or dye, and optional additives, if any, in the melted resin; cooling and pulverizing the mixture; and subjecting the powder product to precise classification to form the magnetic toner particles according to the present invention.

Alternatively, it is also possible to provide a magnetic toner through polymerization. According to the polymerization method, a polymerizable monomer, magnetic iron oxide particles, a polymerization initiator, and optionally a crosslinking agent, a charge control agent and other additives, as desired, may be uniformly dissolved or dispersed to form a monomer composition. Then, the monomer composition or a preliminarily polymerized product thereof is dispersed in a continuous phase (e.g., of water) by means of an appropriate stirrer, and then subjected to polymerization to recover magnetic toner particles having a desired particle size. In case of producing the magnetic toner according to the polymerization method, it is preferred to subject the magnetic iron oxide particles in advance to a hydrophobicity-imparting treatment.

Then, some description will be made regarding the structure and production process of the magnetic iron oxide used in the present invention. The magnetic iron oxide particles used in the present invention contain silicon both at their interiors and surfaces.

When magnetic iron oxide particles prepared in Examples of the present invention described hereinafter were examined with respect to inner silicon distribution by a gradual dissolution analysis, the silicon was found to be present from the central core of each magnetic iron oxide particle and the content thereof was found to increase near the surface with an inclination.

Further, in the magnetic iron oxide particles treated with aluminum hydroxide, the resultant aluminum element is basically present at only the surface and a superficial layer of each magnetic iron oxide particle.

The silicon-containing magnetic iron oxide used in the present invention may for example be produced through a process described below.

As a basic reaction process, a ferrous salt aqueous solution and an alkali hydroxide aqueous solution in an amount of 0.90–0.99 equivalent to $Fe^{2+}$ contained in the ferrous salt aqueous solution, are reacted to form an aqueous reaction liquid containing ferrous hydroxide colloid, which is then aerated with an oxygen-containing gas to form magnetite particles. In this instance, a water-soluble silicic acid containing silicon in a proportion of 50–99 wt. % of the total silicon (0.4–2.0 wt. %) to be contained in the objective magnetic iron oxide is added in advance to either the alkali hydroxide aqueous solution or the reaction liquid containing ferrous hydroxide colloid, and the aeration is performed by passing the oxygen-containing gas for oxidation into the reaction liquid while heating the liquid at 85°–100° C., thereby producing silicon-containing magnetic iron oxide particles from the ferrous hydroxide colloid. Thereafter, an alkali hydroxide aqueous solution in an amount of at least 1.00 equivalent to $Fe^{2+}$ remaining in the suspension liquid after the oxidation and a water-soluble silicic acid salt containing silicon in the remaining amount [i.e., 1–50% of the total content (=0.4–2.0 wt. %)], are added to the suspension liquid, followed by further heating at 85°–100° C. for oxidation, to produce silicon-containing magnetic iron oxide particles.

Then, in the case of effecting the treatment with aluminum hydroxide, into the alkaline suspension liquid containing the silicon-containing magnetic iron oxide particles, a water-soluble aluminum salt is added in an amount of 0.1–2.0 wt. % (calculated as aluminum) with respect to the produced magnetic iron oxide particles. Thereafter, the pH of the system is adjusted to 6–8 to deposit aluminum hydroxide at the surfaces of the magnetic iron oxide particles. Then, the product is subjected to filtration, washing with water, drying and disintegration to form magnetic iron oxide particles used in the present invention. In order to adjust the smoothness and specific surface area, the magnetic iron oxide particles may preferably be subjected to a post-treatment, e.g., by Mix-maller, for applying compression and shearing forces.

The silicic acid to be added for producing the magnetic iron oxide particles may for example be a silicic acid salt, such as commercially available sodium silicate, or silicic acid, such as silicic acid sol formed, e.g., by hydrolysis.

The water-soluble aluminum salt may for example be aluminum sulfate.

As the ferrous salt, for example, it is possible to use iron sulfate generally by-produced in the sulfuric acid process for producing titanium or iron sulfate by-produced in surface washing of steel plates. It is also possible to use iron chloride, etc.

An embodiment of the image forming method will now be described with reference to FIG. 1.

A photosensitive drum 1 surface is negatively charged by a primary charger 702, subjected to image-scanning with laser light 705 to form a digital latent image, and the resultant latent image is reversely developed with a monocomponent magnetic developer 710 comprising a magnetic toner in a developing apparatus 709 which comprises a developing sleeve 704 equipped with a magnetic blade 711 and enclosing a magnet. In the developing zone, the electroconductive support of the photosensitive drum is grounded, and an alternating bias, pulse bias and/or DC bias is applied to the developing sleeve 704 by a bias voltage application means 712. When a transfer paper P is conveyed to a transfer zone, the paper is charged from the back side (opposite side with respect to the photosensitive drum) by a roller transfer means 2 connected to a voltage supply 3, whereby the developed image (toner image) on the photosensitive drum is transferred to the transfer paper P by the contact transfer means 2. Then, the transfer paper P is separated from the photosensitive drum 1 and subjected to fixation by means of a hot pressing roller fixer 707 for fixing the toner image on the transfer paper P.

Residual monocomponent developer remaining on the photosensitive drum after the transfer step is removed by a cleaning means 708 comprising a cleaning blade. It is also possible to omit the cleaning step in case where the residual developer is little in amount. The photosensitive drum 1 after the cleaning is subjected to erase-exposure for discharge by erasure means 706 and then subjected to a repeating cycle commencing from the charging step by the primary charger 702.

The photosensitive drum (electrostatic image-bearing member) 1 comprises a photosensitive layer and a conductive substrate and rotates in the direction of the arrow. The developing sleeve 704 comprising a non-magnetic cylinder as a toner-carrying member rotates so as to move in the same direction as the photosensitive drum 1 surface at the developing zone. Inside the non-magnetic cylinder sleeve 6, a multi-pole permanent magnet (magnet roll) as a magnetic field generating means is disposed so as not to rotate. The monocomponent insulating magnetic developer 710 in the developing apparatus 709 is applied onto the non-magnetic cylinder sleeve 704 and the toner particles are provided with, e.g., a negative triboelectric charge due to friction between the sleeve 704 surface and the toner particles. Further, by disposing the magnetic blade 711, in the vicinity of (with a spacing of 50–500 μm) from the sleeve surface, the thickness of the developer layer is regulated at a thin and uniform thickness (30–300 μm) which is thinner than the spacing between the photosensitive drum 1 and the developing sleeve 704 at the developing zone, so that the developer layer does not contact the photosensitive drum 1. The rotation speed of the sleeve 704 is so adjusted that the circumferential velocity of the sleeve 704 is substantially equal to or close to that of the photosensitive drum surface. It is also possible to constitute the magnetic doctor blade 711 functioning as a counter magnetic pole with a permanent magnet instead of iron. In the developing zone, an AC bias or a pulsed bias may be applied to the sleeve 704 by the biasing means 712. The AC bias may preferably comprise f=200–4000 Hz and Vpp=500–3000 V.

In the developing zone, the toner particles are transferred to the electrostatic image under the action of an electrostatic force exerted by the surface of the photosensitive drum 1 and the AC bias or pulsed bias.

Another embodiment of the image forming apparatus according to the present invention is described with reference to FIG. 4.

It is also possible to replace the magnetic doctor blade 711 with an elastic blade formed of an elastic material, such as silicone rubber, so as to apply the developer onto the developing sleeve while regulating the thickness of the resultant developer layer by a pressing force.

Figure 2:
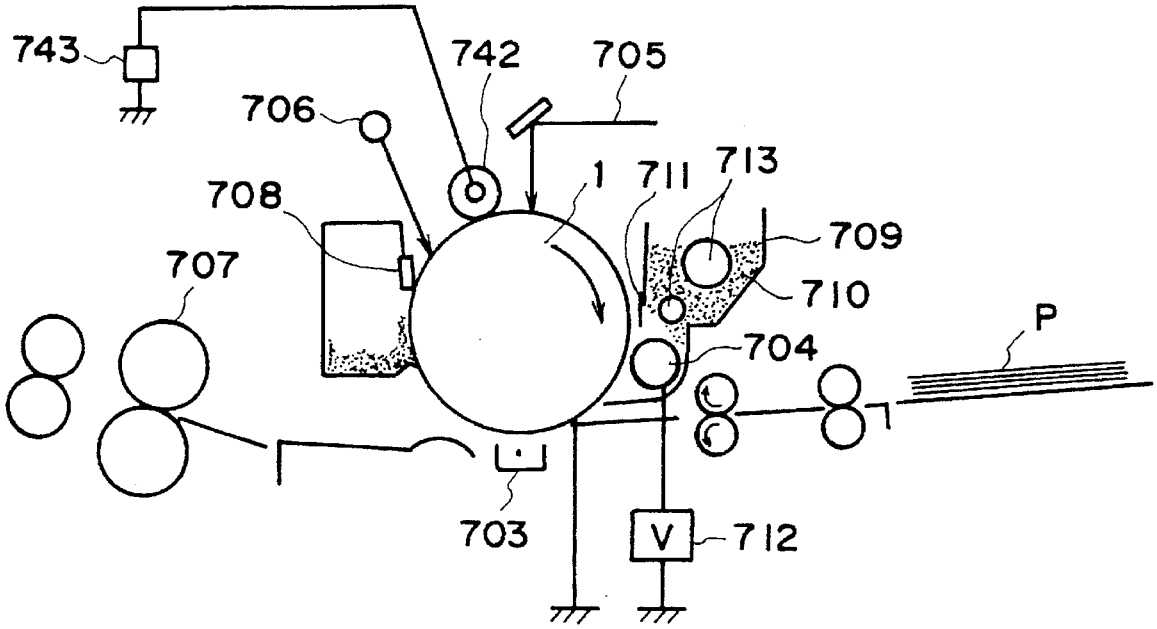
FIGS. 2 and 3 are respectively a schematic illustration of another example of an image forming apparatus suitable for image formation using a magnetic toner according to the invention.

FIG. 2 shows an embodiment of the image forming apparatus including a contact-charging means 742 supplied with a voltage from a bias voltage application means 743 and a corona transfer means 703.

Figure 3:
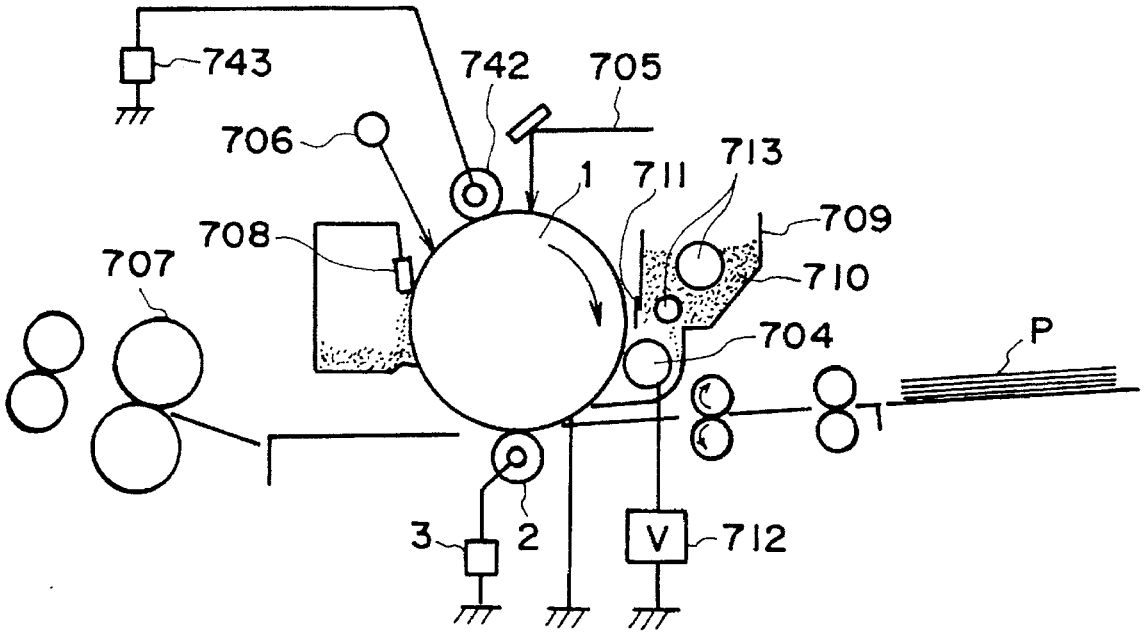

FIG. 3 shows an embodiment of the image forming apparatus including a contact charging means 742 and a contact transfer means 2.

Figure 4:
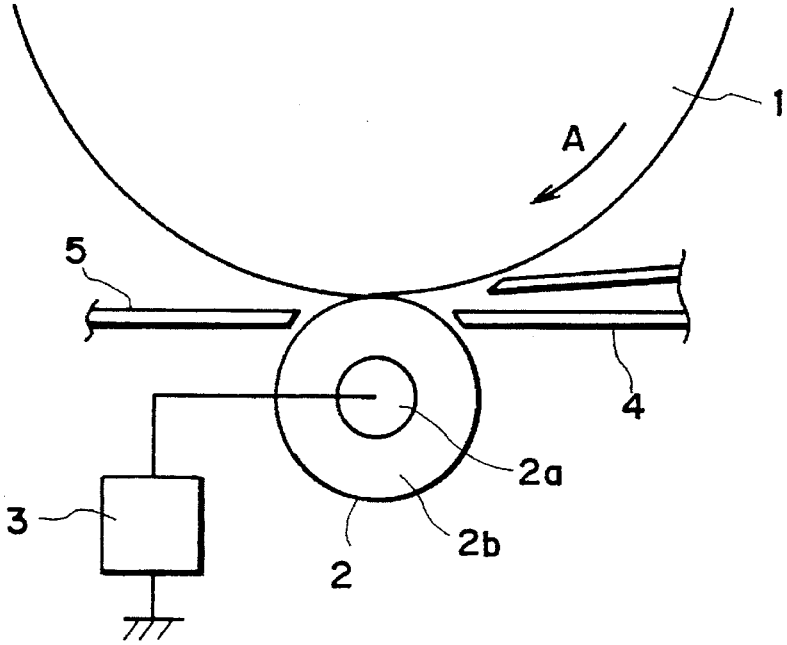
FIG. 4 is a schematic illustration of a transfer apparatus.

FIG. 4 shows a detail of a contact transfer system (as used in the image forming apparatus shown in FIGS. 1 and 3), including a transfer roller which basically comprises a core metal **2*a* and an electroconductive elastic layer 2*b* surrounding the core metal 2*a*. The transfer roller 2 is used to press a transfer material against the surface of the photosensitive drum 1 at a pressing force. The transfer roller 2 rotates at a peripheral speed which is equal to or different from that of the photosensitive drum 1. A transfer material (such as paper) is conveyed through a guide 4 to between the photosensitive drum 1 and the transfer roller 2, where the transfer roller is supplied with a bias voltage of a polarity opposite to that of the toner from a transfer bias voltage supply 3 so that the toner image on the photosensitive drum 1 is transferred onto the face side of the transfer material. Then, the transfer material carrying the transferred toner image sent through a guide 5** to a fixing device.

The electroconductive elastic layer **2*b*** may preferably comprise an elastic material, such as urethane rubber or ethylene-propylene-diene terpolymer (EPDM), containing an electroconductive filler, such as conductive carbon, dispersed therein and having a volume resistivity in the range of ca. $10^6$–$10^{10}$ ohm.cm.

Preferred transfer conditions may include a roller abutting pressure of 5–500 g/cm and a DC voltage of ±0.2–±10 kV.

Figure 5:
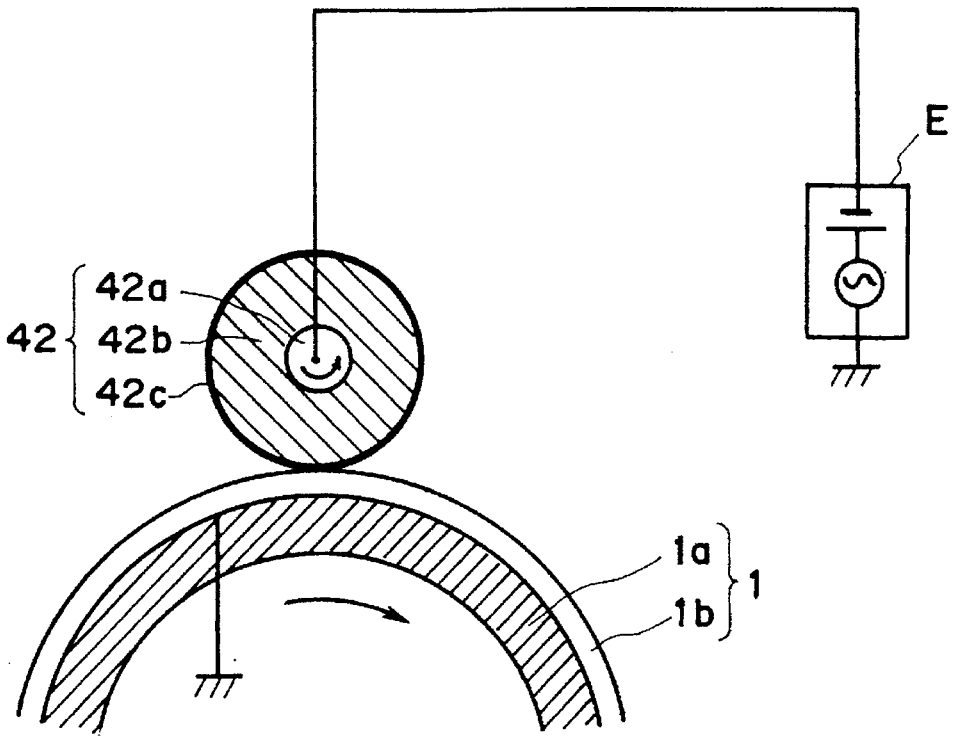
FIG. 5 is a schematic illustration of a charging roller.

FIG. 5 shows a detail of a contact-charging system (as used in image forming apparatus shown in FIGS. 2 and 3). The system includes a rotating drum-shaped electrostatic image bearing member (herein, simply referred to as "photosensitive drum") 1, which basically comprises an electroconductive support layer **1*a* of, e.g., aluminum, and a photoconductor layer 1*b* coating the outer surface of the support layer 1*a***, and rotates at a prescribed peripheral speed (process speed) in a clockwise direction (in the case shown on the drawing).

The photosensitive drum 1 is charged with a charging roller 42 which basically comprises a core metal **42*a*, an electroconductive elastic layer 42*b* surrounding the core metal 42*a*, and a surface layer 42*c*. The charging roller 42 is pressed against the surface of the photosensitive drum 1 at a pressing force and rotates so as to follow the rotation of the photosensitive drum 1. The charging roller 42 is supplied with a voltage from a bias voltage application means E, whereby the surface of the photosensitive drum 1 is charged to a prescribed potential of a prescribed polarity. Then, the photosensitive drum 1** is exposed imagewise to form an electrostatic image thereon, which is then developed into a visual toner image by a developing means.

Preferred process conditions of such a charging roller may for example comprise a roller abutting pressure of 5–500 g/cm and a combination of an AC voltage of 0.5–5 kVpp and frequency of 50 Hz to 5 kH and a DC voltage of ±0.2–±1.5 kV in case of DC-AC superposed voltage application or a DC voltage of ±0.2–±5 kV in case of DC voltage application.

The charging roller (and also a charging blade) may preferably comprise an electroconductive rubber and can be surfaced with a release film, which may for example comprise nylon resin, PVDF (polyvinylidene fluoride), or PVDC (polyvinylidene chloride).

Figure 7:
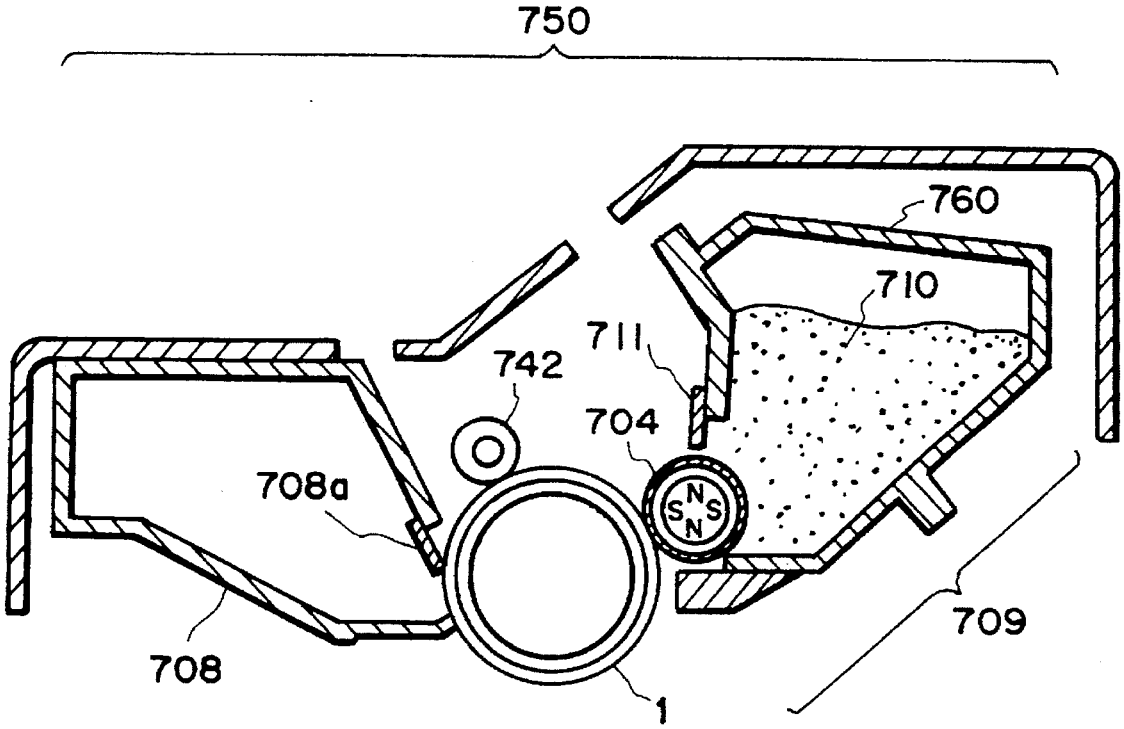
FIG. 7 is a view for illustrating an embodiment of the process cartridge according to the invention.

FIG. 7 shows an embodiment of the process cartridge according to the invention. The process cartridge includes at least a developing means and an electrostatic image bearing member integrated into a form of a cartridge, which is detachably mountable to a main assembly of an image forming apparatus (such as a copying machine and a laser beam printer).

In this embodiment, a process cartridge is shown to integrally include a developing means 709, a drum-shaped electrostatic image-bearing member (photosensitive drum) 1, a cleaner 708 having a cleaning blade 708*a*, and a primary charger (charging roller) 742.

In the cartridge of this embodiment, the developing means 709 comprises a magnetic blade 711 and a toner 760 containing a magnetic toner 710. The magnetic toner is used for development in such a manner that a prescribed electric field is formed between the photosensitive drum 1 and a developing sleeve 704. In order to perform the development suitably, it is very important to accurately control the spacing between the photosensitive drum 1 and the developing sleeve 704.

Hereinbelow, the present invention will be described more specifically based on Production Examples of magnetic iron oxide and Examples of toner. In the following description, "parts" and "%" used to describe compositions are all by weight unless otherwise noted specifically.

PRODUCTION EXAMPLE 1

Into a ferrous sulfate aqueous solution, a sodium hydroxide aqueous solution in an amount of 0.95 equivalent to $Fe^{2+}$ contained therein was added and mixed, to form a ferrous salt aqueous solution containing $Fe(OH)_2$.

Then, to the solution, sodium silicate was added in an amount containing 1.0 wt. % of silicon with respect to the iron in the solution. Then, the resultant ferrous salt aqueous solution containing $Fe(OH)_2$ was aerated with air at 90° C. to cause oxidation at a pH of 6–7.5 thereby forming a suspension liquid containing silicon-containing magnetic iron oxide particles.

Then, to the suspension liquid, a sodium hydroxide aqueous solution in an amount of 1.05 equivalent to the remaining $Fe^{2+}$ in which sodium silicate containing 0.1 wt. % of silicon with respect to iron was dissolved, was added, and the system was heated at 90° C. to effect oxidation under a condition of pH 8–11.5, thereby further forming silicon-containing magnetic iron oxide particles.

The resultant magnetic iron oxide particles were washed, filtered and dried in an ordinary manner, and then subjected to disintegration of the agglomerates thereof by a Mix-maller, whereby the agglomerates were disintegrated into primary particles under application of compressing and shearing forces, and the surfaces of the magnetic iron oxide particles were smoothened. As a result, magnetic iron oxide particles A having properties shown in Tables 1 and 2 were obtained. The magnetic iron oxide particles showed an average particle size of 0.21 μm.

PRODUCTION EXAMPLES 2–6

Magnetic iron oxide particles B–F were prepared in the same manner as in Production Example 1 except for adding different amounts of silicon.

PRODUCTION EXAMPLE 7

Magnetic iron oxide particles G were obtained in the same manner as in Example 6 except that the disintegration treatment was performed by a pin-mill. The magnetic iron oxide G showed a lower smoothness and a larger BET specific surface area compared with the magnetic iron oxide particles F.

PRODUCTION EXAMPLES 8–12

Magnetic iron oxide particles H–L were prepared in the same manner as in Example 3 except that prescribed different amounts of aluminum sulfate were respectively added to the slurry (or suspension liquid) before the filtration, followed by adjustment of pH to 6–8 to surface-coat the magnetic iron oxide particles with aluminum hydroxide, and post treatment in the same manner as in Example 3 including the disintegration by a Mix-maller.

PRODUCTION EXAMPLES 13 and 14

Magnetic iron oxide particles M and N were prepared in a similar manner as in Example 1 but all the prescribed amounts of silicon were added for the first stage reaction and the pH for the reaction was changed to 8–10.

COMPARATIVE PRODUCTION EXAMPLES 1–4

Magnetic iron oxide particles Q–R were prepared in a similar manner as in Example 1, but all the prescribed amounts of silicon were added for the first stage reaction and the sodium hydroxide aqueous solution was added in amounts exceeding 1 equivalent to $Fe^{2+}$, followed by adjustment to different pH values.

COMPARATIVE PRODUCTION EXAMPLE 5

Into ferrous sulfate aqueous solution, sodium silicate was added in an amount to provide a silicon content of 1.8% based on the iron content, and a caustic soda solution in an amount 1.0–1.1 times the equivalent to the ferrous ion, to prepare an aqueous solution containing $Fe(DH)_2$.

While the aqueous solution was maintained at pH 9, air was blown thereinto to cause oxidation at 85° C., to form silicon-containing magnetic iron oxide particles.

Then, into the resultant suspension liquid, an aqueous solution containing ferrous sulfate in an amount 1.1 times the equivalent to the previously added alkali (sodium in the sodium silicate and sodium in the caustic soda) was added. Further, while the suspension liquid was maintained at pH 8, air was blown thereinto to cause oxidation, followed by adjustment of the pH to a weak alkalline side at the final stage, to form magnetic iron oxide particles. The produced magnetic iron oxide particles were washed, recovered by filtration, dried and then treated for disintegration of the agglomerates, in ordinary manner, to produce magnetic iron oxide particles.

COMPARATIVE PRODUCTION EXAMPLE 6

Spherical magnetic iron oxide particles having a BET specific surface area of 6.8 $m^2/g$ were blended with 0.8 wt. % of silica fine powder having a BET specific surface area of 400 $m^2/g$ by means of a Mix-maller, to obtain magnetic iron oxide particles T.

TABLE 1

| | Particles | Ave. size (μm) | Si content (%) | Surface Fe/Si ratio(XPS) | Smoothness | Bulk density (g/cm$^3$) | BET surface area (m$^2$/g) | Al content (%) | Surface Fe/Al ratio(XPS) |
|---|---|---|---|---|---|---|---|---|---|
| Prod. Ex. | | | | | | | | | |
| 1 | A | 0.21 | 1.09 | 1.8 | 0.53 | 1.10 | 10.0 | — | — |
| 2 | B | 0.19 | 1.82 | 1.2 | 0.41 | 1.12 | 14.6 | — | — |
| 3 | C | 0.21 | 0.80 | 2.4 | 0.57 | 1.15 | 9.7 | — | — |
| 4 | D | 0.21 | 0.60 | 2.8 | 0.59 | 1.09 | 9.2 | — | — |
| 5 | E | 0.20 | 0.48 | 3.5 | 0.65 | 1.00 | 8.7 | — | — |
| 6 | F | 0.21 | 1.18 | 1.6 | 0.53 | 1.16 | 10.1 | — | — |
| 7 | G | 0.21 | 1.18 | 1.6 | 0.48 | 0.85 | 11.5 | — | — |
| 8 | H | 0.21 | 0.80 | 2.4 | 0.60 | 1.10 | 9.1 | 0.25 | 1.4 |
| 9 | I | 0.21 | 0.80 | 2.4 | 0.59 | 1.11 | 9.3 | 0.05 | 8.7 |
| 10 | J | 0.21 | 0.80 | 2.4 | 0.56 | 1.10 | 9.8 | 0.80 | 0.95 |
| 11 | K | 0.21 | 0.80 | 2.4 | 0.52 | 1.12 | 10.5 | 1.52 | 0.32 |
| 12 | L | 0.21 | 0.80 | 2.4 | 0.50 | 1.08 | 11.0 | 2.20 | 0.20 |
| 13 | M | 0.21 | 1.68 | 1.2 | 0.29 | 0.75 | 18.9 | — | — |
| 14 | N | 0.25 | 0.87 | 1.3 | 0.31 | 0.81 | 14.8 | — | — |
| Comp. Prod. Ex. | | | | | | | | | |
| 1 | O | 0.21 | 1.68 | 1.0 | 0.30 | 0.65 | 18.3 | — | — |
| 2 | P | 0.34 | 1.50 | 1.1 | 0.28 | 0.80 | 12.0 | — | — |
| 3 | Q | 0.21 | 0.25 | 4.2 | 0.81 | 1.06 | 6.8 | — | — |
| 4 | R | 0.20 | 2.4 | 0.9 | 0.28 | 0.60 | 20.4 | — | — |
| 5 | S | 0.21 | 1.8 | 0.8 | 0.24 | 0.49 | 23.0 | — | — |
| 6 | T | 0.23 | 0.80 | 0.05 | 0.51 | 1.04 | 9.7 | — | — |

TABLE 2

| | Particles | Total pore volume (ml/g) | Micro-pore surface area (m$^2$/g) | Meso-pore surface area (m$^2$/g) | Hysteresis between Ads.-Des isotherms | Moisture content 23.5° C./65% (%) | Moisture content 32.5° C./85% (%) |
|---|---|---|---|---|---|---|---|
| Prod. Ex. | | | | | | | |
| 1 | A | $1.1 \times 10^{-2}$ | 4.8 | 5.3 | none | 0.92 | 1.24 |
| 2 | B | $1.5 \times 10^{-2}$ | 7.2 | 7.3 | none | 1.05 | 1.56 |
| 3 | C | $9.8 \times 10^{-3}$ | 4.1 | 5.2 | none | 0.86 | 1.00 |
| 4 | D | $9.5 \times 10^{-3}$ | 4.1 | 4.3 | none | 0.41 | 0.62 |
| 5 | E | $9.2 \times 10^{-3}$ | 3.7 | 3.9 | none | 0.54 | 0.72 |
| 6 | F | $1.0 \times 10^{-2}$ | 3.9 | 5.9 | none | 0.89 | 1.05 |
| 7 | G | $1.2 \times 10^{-2}$ | 4.5 | 6.7 | none | 0.96 | 1.18 |
| 8 | H | $1.1 \times 10^{-2}$ | 5.0 | 5.3 | none | 0.89 | 1.03 |
| 9 | I | $1.3 \times 10^{-2}$ | 5.2 | 6.2 | none | 0.87 | 1.01 |
| 10 | J | $1.2 \times 10^{-2}$ | 4.7 | 6.5 | none | 0.92 | 1.10 |
| 11 | K | $1.2 \times 10^{-2}$ | 4.9 | 5.9 | none | 0.98 | 1.23 |
| 12 | L | $1.2 \times 10^{-2}$ | 5.2 | 5.8 | none | 1.05 | 1.37 |
| 13 | M | $1.9 \times 10^{-2}$ | 9.8 | 9.9 | yes | 1.12 | 1.63 |
| 14 | N | $1.5 \times 10^{-2}$ | 7.8 | 7.2 | yes | 1.03 | 1.72 |
| Comp. Prod. Ex. | | | | | | | |
| 1 | O | $1.9 \times 10^{-2}$ | 9.0 | 9.1 | yes | 1.12 | 1.75 |
| 2 | P | $1.3 \times 10^{-2}$ | 6.0 | 5.9 | yes | 0.92 | 1.53 |
| 3 | Q | $6.9 \times 10^{-3}$ | 3.2 | 3.6 | none | 0.37 | 0.53 |
| 4 | R | $2.2 \times 10^{-2}$ | 11.3 | 9.3 | yes | 1.17 | 1.89 |
| 5 | S | $2.5 \times 10^{-2}$ | 12.5 | 10.5 | yes | 1.20 | 2.01 |
| 6 | T | $1.1 \times 10^{-2}$ | 4.7 | 5.0 | none | 1.10 | 1.82 |

EXAMPLE 1

| | |
|---|---|
| Styrene/2-ethylhexylacrylate copolymer (copolymerization wt. ratio = 88/12; Mw = 24 × $10^4$, Tg = 60° C.) | 100 parts |
| Magnetic iron oxide particles A | 100 parts |
| Low-molecular weight ethylene/propylene copolymer | 4 parts |
| Negative charge control agent A (monoazo iron complex represented by the following formula) | 2 parts |

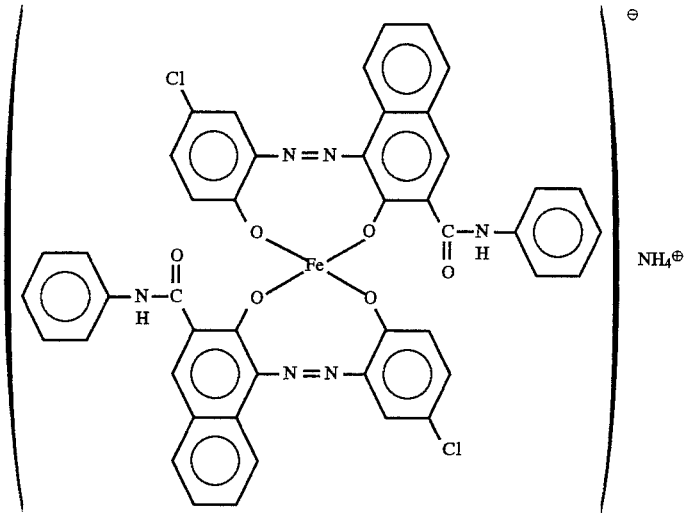

A blend of the above ingredients was melt-kneaded at 140° C. by means of a twin-screw extruder. The kneaded product was cooled, coarsely crushed by a hammer mill, finely pulverized by means of a jet mill, and classified by a fixed-wall type pneumatic classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K. K.), thereby to obtain a negatively chargeable magnetic toner having a weight-average particle size ($D_4$) of 6.8 μm and containing 0.2 wt. % of magnetic toner particles of 12.7 μm or larger.

100 wt. parts of the magnetic toner, 1.2 wt. parts of hydrophobic silica fine powder treated successively with dimethyldichlorosilane, hexamethyldisilazane and silicone oil, and 0.08 wt. part of styrene-acrylic copolymer resin fine particles (average particle size=0.05 μm) obtained by soap-free polymerization, were blended by a Henschel mixer to obtain a mono-component-type magnetic developer.

Separately, a commercially available laser beam printer ("LBP-8II" including an OPC photosensitive drum, mfd. by Canon K. K.) was re-modeled so as to change the process speed from 8 sheets/min. to 16 sheets/min. and include a contact-transfer system as shown in FIG. 4 and a contact-charging system as shown in FIG. 5. The re-modeled laser beam printer had a structure functionally identical to the one shown in FIG. 3.

Regarding the transfer system shown in FIG. 4, the transfer roller 2 was surfaced with an electroconductive rubber layer comprising EPDM (ethylene-propylenediene terpolymer) containing electroconductive carbon and showing a volume resistivity of $10^8$ ohm.cm and a surface hardness of 27 degrees. The transfer roller was driven under the conditions including a transfer current of 1 μA, a transfer voltage of +2000 V, and an abutting pressure of 50 g/cm.

Regarding the charging system shown in FIG. 5, the charging roller 42 as the primary charger, had an outer diameter of 12 mm and comprised an electroconductive rubber layer 42*b* of EPDM and a 10 μm-thick surface layer 42*c* of nylon resin. The charging roller 42 showed a hardness of 54.5 degrees (ASKER-C). The charging roller 42 was supplied with a prescribed voltage through the core metal 42*a* from a voltage supply E supplying a DC voltage superposed with an AC voltage.

Then, the above-prepared magnetic developer was incorporated in the re-modeled laser beam printer and used for image formation in the following manner. An OPC photosensitive drum was primarily charged at −700 V by the charging roller 42, and an electrostatic latent image for reversal development was formed thereon. The developer was formed in a layer on a developing sleeve (containing magnet) so as to form a clearance (300 μm) from the photosensitive drum at the developing position. An AC bias (f=1,800 Hz and Vpp=1,600 V) and a DC bias ($V_{DC}$=−500 V) were applied to the sleeve, and an electrostatic image having a light-part potential of −170 V was developed by the reversal development mode, to form a magnetic toner image on the OPC photosensitive drum. The thus-formed toner image was transferred to plain paper under application of the above-mentioned positive transfer voltage, and then fixed to the plain paper by passing through a hot-pressure roller fixer.

In this way, successive image formation was performed up to 10,000 sheets according to an intermittent mode including a rest period of ca. 12 sec after an image forming step of ca. 2 sec for each sheet in a normal temperature—normal humidity (23.5° C.—60% RH) environment while replenishing the magnetic developer, as required.

The images were evaluated with respect to an image density as measured by a MacBeth reflection densitometer, and fog as measured by comparison between a fresh plain paper and a plain paper on which a solid white image was printed with respect to whiteness as measured by a reflection meter (mfd. by Tokyo Denshoku K. K.). The results are shown in Table 3 appearing hereinafter.

Similar image forming tests were performed in a high temperature—high humidity (32.5° C.—85% RH) environment and in a low temperature—low humidity (10° C.—15% RH) environment. The results are also shown in Table 3.

Figure 6:
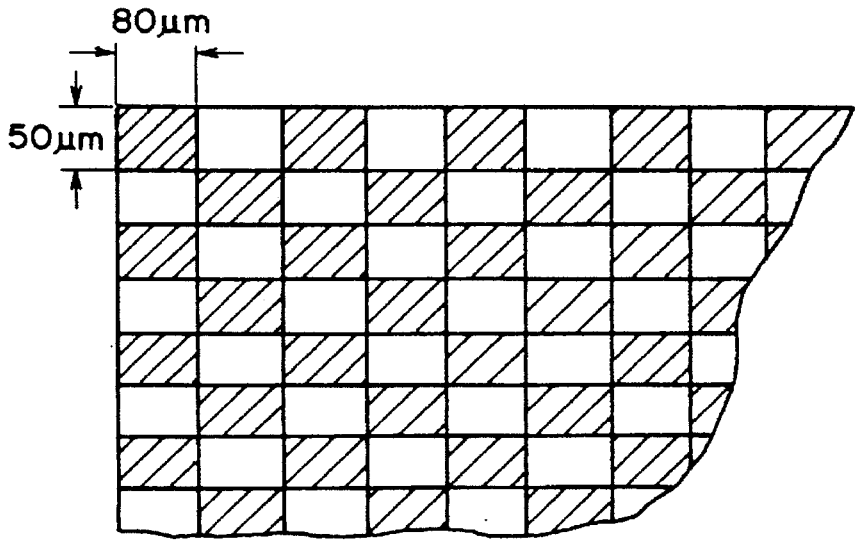
FIG. 6 is an illustration of a checker pattern for testing the developing performance of a magnetic toner.

In the high temperature—high humidity environment, the image forming test was performed on 4000 sheets, then the laser beam printer was held in the same environment for 3 days, and the image forming test was performed on further 4000 sheets. For the fog evaluation, plain paper sheets subjected to image formation on both sides were used. Dot reproducibility was evaluated by forming a checker pattern shown in FIG. 6 in the latter half of the successive image formation in the high temperature—high humidity environment.

EXAMPLES 2–14

Magnetic toners each having a particle size distribution similar to that obtained in Example 1 were prepared in the same manner as in Example 1 except that the magnetic iron oxide particles were replaced with the magnetic iron oxide particles B to N, respectively, produced in Production Examples 2–14.

The magnetic toners were evaluated in the same manner as in Example 1. The results are shown in Table 3.

EXAMPLE 15

| | |
|---|---|
| Styrene/n-butyl acrylate copolymer (wt. ratio = 83/17, Mw = 28 × $10^4$, Tg = 60° C.) | 100 parts |
| Magnetic iron oxide particles B | 60 parts |
| Negative charge control agent A | 1.5 parts |
| Low-molecular weight ethylene/propylene copolymer | 4 parts |

A blend of the above ingredients was melt kneaded at 140° C. by means of a twin-screw extruder. The kneaded product was cooled, coarsely crushed by a hammer mill, finely pulverized by a jet mill, and classified by a pneumatic classifier to obtain a negatively chargeable magnetic toner having a weight-average particle size ($D_4$) of 11.4 μm (containing 33 wt. % of magnetic toner particles of 12.7 μm or larger.)

100 parts of the magnetic toner and 0.6 part of hydrophobic colloidal silica treated with dimethylsilicone oil were blended by a Henschel mixer to prepare a magnetic developer.

The magnetic developer was charged in the process cartridge of a laser beam printer ("LBP-8II") having a structure functionally identical to the one shown in FIG. 1 and evaluated by image formation in the same manner as in Example 1. The results are shown in Table 3.

EXAMPLE 16

A magnetic toner was prepared and evaluated in the same manner as in Example 15 except that the negative charge control agent A was replaced by a monoazo chromium complex (negative charge control agent) obtained by changing the central atom of the negative charge control agent A from iron to chromium.

EXAMPLE 17

| | |
|---|---|
| Styrene/n-butyl acrylate (wt. ratio = 83/17, Mw = 30 × $10^4$, Tg = 60° C.) | 100 parts |
| Magnetic iron oxide particles C | 120 parts |
| Negative charge control agent A | 3 parts |
| Low-molecular weight ethylene/propylene copolymer | 4 parts |

From the above ingredients, a magnetic toner having a weight-average particle size ($D_4$) of 5.4 μm (containing 0 wt. % of particles of 12.7 μm or larger) was prepared.

100 parts of the magnetic toner, 1.6 parts of the hydrophobic colloidal silica treated with silicone oil, etc., used in Example 1 and 0.1 part of the resin fine particles used in Example 1, were blended by a Henschel mixer to obtain a magnetic developer.

The developer was charged in the re-modeled cartridge used in Example 1 and evaluated by image formation in the same manner as in Example 1.

EXAMPLE 18

A magnetic developer was prepared and evaluated in the same manner as in Example 1 except that the resin fine particles as an external additive to the magnetic developer were omitted.

The developer showed substantially identical performances regarding the image density, fog and dot reproducibility compared with the developer of Example 1, but showed some degree of melt-sticking onto the photosensitive drum at the final stage of successive image formation in the high temperature—high humidity environment.

EXAMPLE 19

A magnetic toner having a similar particle size distribution was prepared in the same manner as in Example 15 except that the amount of the magnetic iron oxide particles B was reduced to 40 parts and instead 2 parts of carbon black was added.

The resultant magnetic toner particles showed a saturation magnetization of 20.0 emu/g at a magnetic field of 1 kilo-oersted at room temperature as measured by a tester ("VSM P-1-10", available from Toei Kogyo K. K.). The density was 1.42 g/$cm^3$.

The magnetic toner was evaluated in the same manner as in Example 15 except that the developing bias voltage was changed to a DC bias component Vdc=–450 volts superposed with an AC bias component of Vpp=1200 volts and f=2000 Hz.

Compared with Example 15, even better images were obtained with little scattering, and a small toner consumption was confirmed.

COMPARATIVE EXAMPLES 1–4

Magnetic toners each having a particle size distribution similar to that obtained in Example 1 were prepared in the same manner as in Example 1 except that the magnetic iron oxide particles were replaced with the magnetic iron oxide particles Q to R, respectively, produced in Comparative Production Examples 1–4.

The magnetic toners were evaluated in the same manner as in Example 1. The results are shown in Table 3.

COMPARATIVE EXAMPLE 5

A magnetic toner having a weight-average particle size of 11.8 μm (containing 54 wt. % of particles having a particle size of 12.7 μm or larger) was prepared in a similar manner as in Example 15 by using the same magnetic iron oxide particles B prepared in Production Example 2 and evaluated in the same manner as in Example 15.

COMPARATIVE EXAMPLES 6 and 7

Magnetic toners were prepared in the same manner as in Example 1 except that the magnetic iron oxide particles A were replaced by magnetic iron oxide particles S and T, respectively, produced in Comparative Production Examples 5 and 6.

The magnetic toners were evaluated in the same manner as in Example 1. The results are also shown in Table 3. Compared with the magnetic toner of Example 1, the magnetic toners provided lower image densities of 1.14 and 1.12, respectively, after standing for 3 days in the high temperature—high humidity environment.

TABLE 3*

| | Magnetic toner | | | Image density*3 | | | | | | Fog L.T.-L.H. | Dot*5 |
|---|---|---|---|---|---|---|---|---|---|---|---|
| | Dav*1 | Content of ≧12.7 μm | | N.T. - N.H. | | | H.T. - H.H. | | | after | reproducibility |
| | (μm) | (wt. %) | MIO*2 | Initial | Final | L.T.-L.H. | Initial | Medium*4 | Final | 4000 sheets | H.T. - H.H. |
| Prod. Ex. | | | | | | | | | | | |
| 1 | 6.7 | 0.2 | A | 1.46 | 1.45 | 1.45 | 1.41 | 1.37 | 1.36 | 1.8(%) | ○ |
| 2 | 6.8 | 0.4 | B | 1.47 | 1.46 | 1.47 | 1.40 | 1.34 | 1.36 | 1.6 | ○Δ |
| 3 | 6.9 | 0.7 | C | 1.46 | 1.46 | 1.47 | 1.45 | 1.42 | 1.44 | 1.8 | ○ |
| 4 | 6.8 | 0.4 | D | 1.43 | 1.40 | 1.42 | 1.40 | 1.37 | 1.40 | 2.0 | ○ |
| 5 | 6.8 | 0.4 | E | 1.42 | 1.40 | 1.42 | 1.38 | 1.34 | 1.37 | 2.2 | ○Δ |
| 6 | 6.7 | 0.2 | F | 1.46 | 1.46 | 1.47 | 1.42 | 1.39 | 1.40 | 1.8 | ○ |
| 7 | 6.8 | 0.7 | G | 1.46 | 1.45 | 1.45 | 1.40 | 1.36 | 1.35 | 1.8 | ○ |
| 8 | 6.9 | 1.1 | H | 1.46 | 1.47 | 1.47 | 1.45 | 1.43 | 1.45 | 1.6 | ○ |
| 9 | 6.9 | 0.8 | I | 1.46 | 1.46 | 1.47 | 1.45 | 1.42 | 1.45 | 1.8 | ○ |
| 10 | 7.0 | 0.6 | J | 1.46 | 1.47 | 1.47 | 1.44 | 1.43 | 1.44 | 2.0 | ○ |
| 11 | 6.9 | 0.5 | K | 1.45 | 1.45 | 1.47 | 1.43 | 1.38 | 1.39 | 2.2 | ○Δ |
| 12 | 6.8 | 0.5 | L | 1.45 | 1.44 | 1.46 | 1.42 | 1.34 | 1.34 | 2.3 | ○Δ |
| 13 | 6.6 | 0.2 | M | 1.45 | 1.46 | 1.45 | 1.38 | 1.32 | 1.36 | 1.7 | ○Δ |
| 14 | 6.7 | 0.5 | N | 1.45 | 1.46 | 1.45 | 1.38 | 1.31 | 1.35 | 1.9 | ○Δ |
| 15 | 11.4 | 33 | B | 1.42 | 1.43 | 1.43 | 1.42 | 1.38 | 1.40 | 2.0 | ○Δ |
| 16 | 6.8 | 0.4 | B | 1.42 | 1.43 | 1.43 | 1.41 | 1.38 | 1.39 | 2.3 | ○Δ |
| 17 | 5.4 | 0 | C | 1.43 | 1.46 | 1.46 | 1.41 | 1.36 | 1.39 | 2.4 | ○ |
| 18 | 6.7 | 0.3 | A | 1.46 | 1.45 | 1.45 | 1.40 | 1.38 | 1.36 | 1.8 | ○ |
| 19 | 6.8 | 0.4 | B | 1.42 | 1.43 | 1.43 | 1.42 | 1.38 | 1.41 | 2.6 | Δ |
| Comp. Ex. | | | | | | | | | | | |
| 1 | 6.8 | 0.6 | O | 1.42 | 1.41 | 1.43 | 1.40 | 1.25 | 1.30 | 3.2(%) | Δ |
| 2 | 6.7 | 0.4 | P | 1.42 | 1.42 | 1.44 | 1.39 | 1.29 | 1.31 | 2.5 | Δ |
| 3 | 6.9 | 0.7 | Q | 1.35 | 1.36 | 1.27 | 1.35 | 1.27 | 1.23 | 3.5 | Δ |
| 4 | 6.8 | 0.7 | R | 1.43 | 1.42 | 1.43 | 1.41 | 1.21 | 1.28 | 3.4 | Δ |
| 5 | 11.8 | 54 | B | 1.41 | 1.39 | 1.27 | 1.35 | 1.20 | 1.18 | 5.5 | Δ |
| 6 | 6.7 | 0.3 | S | 1.41 | 1.40 | 1.39 | 1.39 | 1.18 | 1.14 | 3.1 | Δ |
| 7 | 6.8 | 0.4 | T | 1.40 | 1.39 | 1.32 | 1.35 | 1.16 | 1.12 | 4.0 | Δ |

*Some notes to this table are given in the following page.

Notes to Table 3

*1Dav. = weight-average particle size. of magnetic toner (μm).

*2MIO = magnetic iron oxide particles.

*3The following abbreviations stand for the respective envirormnental conditions for the successive image formation tests.

N.T. - N.H. = normal temperature - normal humidity (23.5° C. - 60% RH.)

H.T. - H.H. = high temperature - high humidity (32.5° C. - 85% RH)

L.T. - L.H. = low temperature - low humidity (10° C. - 15% RH)

*4"Medium" stands for a state immediately after commencement of image formation after standing for 3 days in the high temperature - high humidity environment.

*5Dot reproducibility was evaluated by the reproducibility of a checker pattern as shown in FIG. 7 including 100 unit square dots each measuring 80 μm × 50 μm, by observation through a microscope while noticing the clearness of the image, particularly scattering to the non-image parts, and the number of defects (lack) of black dots. The symbols denote the following results:

○: Less than 2 defects/100 dots

○Δ: 3–5 defects/100 dots

Δ: 6–10 defects/100 dots x: 11 or more defects/100 dots

What is claimed is:

1. A magnetic toner comprising magnetic toner particles containing a binder resin and magnetic iron oxide particles; wherein the magnetic toner has a weight-average particle size of at most 13.5 μm;

the magnetic toner has a particle size distribution such that magnetic toner particles having a particle size of at least 12.7 μm are contained in an amount of at most 50 wt. %;

the magnetic iron oxide particles have a silicon content of 0.4–2.0 wt. % based on iron;

the magnetic iron oxide particles have an Fe/Si atomic ratio of 1.2–2.8 at the utmost surfaces thereof;

the magnetic iron oxide particles have a smoothness of 0.45–0.7; and the magnetic iron oxide particles have an aluminum content from 0 to 0.8 wt. % based on iron.

2. The magnetic toner according to claim 1, wherein the magnetic iron oxide particles have a bulk density of at least 0.8 g/cm$^3$.

3. The magnetic toner according to claim 1, wherein the magnetic iron oxide particles have a BET specific surface area of at most 15.0 m$^2$/g.

4. The magnetic toner according to claim 1, wherein the magnetic iron oxide particles have an Fe/Al atomic ratio of 0.3–10.0 at the utmost surfaces thereof.

5. The magnetic toner according to claim 1, wherein the magnetic iron oxide particles have a bulk density of at least 0.8 g/cm$^3$ and a BET specific surface area of at most 15.0 m$^2$/g.

6. The magnetic toner according to claim 5, wherein the magnetic iron oxide particles have been treated with an aluminum compound.

7. The magnetic toner according to claim 6, wherein the magnetic iron oxide particles have an Fe/Al atomic ratio of 0.3–10.0 at the utmost surfaces thereof.

8. The magnetic toner according to claim 1, wherein the magnetic toner has a weight-average particle size of 3.5–13.5 μm and contains at most 40 wt. % of magnetic toner particles having a particle size of at least 12.7 μm.

9. The magnetic toner according to claim 8, wherein the magnetic toner has a weight-average particle size of 4.0–11.0 μm and contains at most 30 wt. % of magnetic toner particles having a particle size of at least 12.7 μm.

10. The magnetic toner according to claim 1, wherein the magnetic iron oxide particles have a silicon content of 0.5–0.9 wt. % based on iron.

11. The magnetic toner according to claim 1, wherein the magnetic iron oxide particles have been treated with aluminum hydroxide in an amount of 0.5–1.0 wt. % calculated as aluminum and have an Fe/Al atomic ratio of 0.3–5.0 at the utmost surfaces thereof.

12. The magnetic toner according to claim 11, wherein the magnetic iron oxide particles have an Fe/Al atomic ratio of 0.3–2.0 at the utmost surfaces thereof.

13. The magnetic toner according to claim 1, wherein the magnetic iron oxide particles have a bulk density of at least 1.0 g/cm$^3$, a BET specific surface area of at most 12.0 m$^2$/g, and an average particle size of 0.1–0.4 μm.

14. The magnetic toner according to claim 13, wherein the magnetic iron oxide particles have a smoothness of 0.5–0.7 and an average particle size of 0.1–0.3 μm.

15. The magnetic toner according to claim 1, wherein the magnetic iron oxide particles have a total surface pore volume of $7.0\times10^{-3}$–$15.0\times10^{-3}$ ml/g.

16. The magnetic toner according to claim 15, wherein the magnetic iron oxide particles have a total surface pore volume of $8.0\times10^{-3}$–$12.0\times10^{-3}$ ml/g.

17. The magnetic toner according to claim 1, wherein the magnetic iron oxide particles have a surface pore distribution such that micro-pores having a pore diameter smaller than 20 Å provide a total specific surface area which is equal to or smaller than that of meso-pores having a pore diameter of at least 20 Å.

18. The magnetic toner according to claim 1, wherein the magnetic iron oxide particles have a moisture content of 0.4–1.0 wt. % at a temperature of 23.5° C. and a humidity of 65% RH, and a moisture content of 0.6–1.5 wt. % at a temperature of 32.5° C. and a humidity of 85% RH, the moisture contents providing a difference therebetween not exceeding 0.6 wt. %.

19. The magnetic toner according to claim 18, wherein the magnetic iron oxide particles have a moisture content of 0.45–0.90 wt. % at a temperature of 23.5° C. and a humidity of 65% RH, and a moisture content of 0.6–1.10 wt. % at a temperature of 32.5° C. and a humidity of 85% RH, the moisture contents providing a difference therebetween not exceeding 0.3 wt. %.

20. The magnetic toner according to claim 1, wherein the magnetic iron oxide particles further contain a negative charge control agent.

21. The magnetic toner according to claim 20, wherein the magnetic charge control agent is a monoazo iron complex salt represented by the following formula:

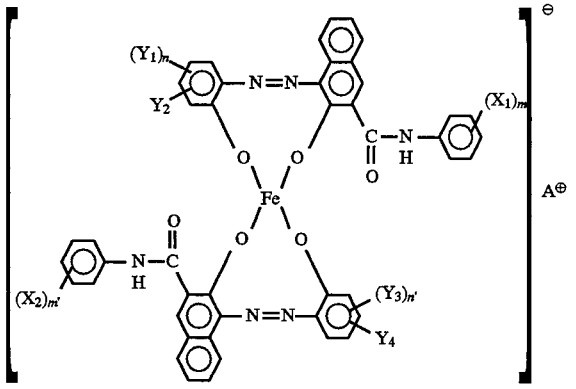

wherein $X_1$ and $X_2$ independently are hydrogen, lower alkyl, lower alkoxy, nitro or halogen;

m and m' independently are an integer of 1–3;

$Y_1$ and $Y_3$ independently denote hydrogen, $C_1$–$C_{18}$ alkyl, $C_2$–$C_{18}$ alkenyl, sulfonamide, mesyl, sulfonic acid, carboxy ester, hydroxy, $C_1$–$C_{18}$ alkoxy, $C_2$–$C_{18}$ acetylamino, benzoyl, amino or halogen;

n and n' independently are an integer of 1–3;

$Y_2$ and $Y_4$ independently are hydrogen or nitro;

$A^{\oplus}$ denotes $H^+$, $Na^+$, $K^+$ or $NH_4^+$.

22. The magnetic toner according to claim 20, wherein the negative charge control agent is an organic iron compound represented by the following formula:

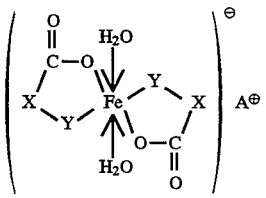

wherein X is

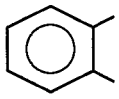

capable of having a substituent,

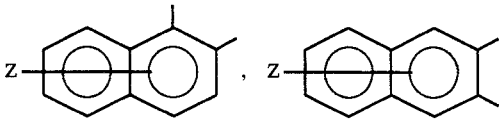

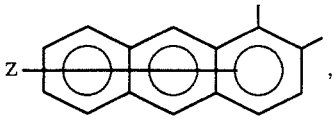

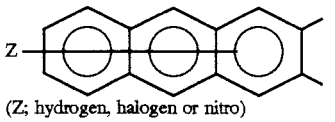

(Z; hydrogen, halogen or nitro)

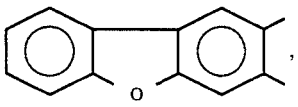

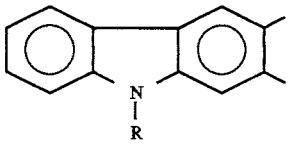

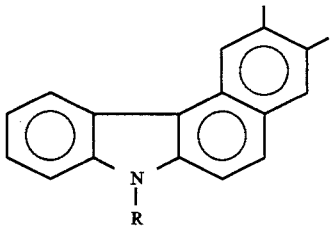

(R is hydrogen, $C_1$–$C_{18}$ alkyl or alkenyl)

Y is —O— or —C—O—;

$A^{\oplus}$ is $H^+$, $Na^+$, $NH_4^+$ or aliphatic ammonium.

23. The magnetic toner according to claim 20, wherein the negative charge control agent is an N,N'-bisarylurea derivative represented by the following formula:

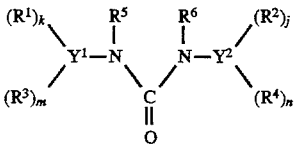

wherein $Y_1$ and $Y_2$ independently are phenyl, naphthyl or anthryl;

$R_1$ and $R_2$ independently are halogen, nitro, sulfonic acid, carboxyl, carboxylate, cyano, carbonyl, alkyl, alkoxy or amino;

$R_3$ and $R_3$ independently are hydrogen, alkyl, alkoxy, phenyl capable of having a substituent, aralkyl capable of having a substituent, or amino;

$R_5$ and $R_6$ independently are hydrogen or $C_1$–$C_8$ hydrocarbon group, k and j are independently an integer of 0–3 with the proviso that both cannot be 0; and m and n are independently 1 or 2.

24. The magnetic toner according to claim 1, wherein the magnetic iron oxide particles are contained in an amount of 20–200 wt. parts per 100 wt. parts of the binder resin.

25. A process cartridge, comprising at least a developing means and a photosensitive member;

said developing means and photosensitive member being integrated into a cartridge disposed detachably attachable to an apparatus main assembly, said developing means including a magnetic toner according to any one of claims 1–24.

26. An image forming method, comprising:

forming an electrostatic image on an electrostatic image-bearing member, and developing the electrostatic image with a magnetic toner according to any one of claims 1–24 held in a developing means to form a toner image on the electrostatic image-bearing member.

27. The image forming method according to claim 26, wherein the toner image on the electrostatic image-bearing member is transferred to a transfer-receiving material.

28. The image forming method according to claim 26, wherein the electrostatic image-bearing member is charged by a contact-charging means and then exposed to light to form a digital electrostatic image thereon, the digital electrostatic image is developed with the magnetic toner, and the resultant toner image on the electrostatic image-bearing member is transferred to the transfer-receiving material by a contact transfer means.

29. The magnetic toner according to claim 1, wherein the magnetic iron oxide particles have an Fe/Si atomic ratio of 1.6–2.8 at the utmost surfaces thereof.

* * * * *

UNITED STATES PATENT AND TRADEMARK OFFICE

CERTIFICATE OF CORRECTION

PATENT NO. : 5,663,026

DATED : September 2, 1997

INVENTOR(S): TAKASHIGE KASUYA ET AL.

It is certified that error appears in the above-identified patent and that said Letters Patent is hereby corrected as shown below:

ON TITLE PAGE AT [56], REFERENCES CITED, FOREIGN PATENT DOCUMENTS

"62-278131 12/1987"
should read --62-278131 12/1987 Japan--;

"Japan ..... Japan" should read --Japan--.

ON TITLE PAGE AT [57], ABSTRACT

Line 11, "a" should be deleted.

COLUMN 1

Line 22, "after" should read --after being--.

COLUMN 2

Line 14, "number" should read --amount--;
Line 24, "to an extreme vicinity to" should read --close to--;
Line 44,"step" should read --steps--;
Line 48, "result in" should read --results in an --;
Line 50, "fog," should read --fog--.

UNITED STATES PATENT AND TRADEMARK OFFICE

CERTIFICATE OF CORRECTION

PATENT NO. : 5,663,026

DATED : September 2, 1997

INVENTOR(S): TAKASHIGE KASUYA ET AL.

It is certified that error appears in the above-identified patent and that said Letters Patent is hereby corrected as shown below:

COLUMN 3

Line 20, "week" should read --weak--.

COLUMN 5

Line 41, "result" should read --results--.

COLUMN 7

Line 10, "Further," should read --Further, if--.

COLUMN 9

Line 29, "with" should read --with a--;
Line 39, "ethyltrichlorosilane" should read --ethyltrichlorosilane,--.

COLUMN 13

Line 54, "(z; hydrogen," should read --(2: hydrogen,--.

COLUMN 14

Line 43, "$R_3$ and $R_3$" should read --$R_3$ and $R_4$--.

UNITED STATES PATENT AND TRADEMARK OFFICE

CERTIFICATE OF CORRECTION

PATENT NO. : 5,663,026

DATED : September 2, 1997

INVENTOR(S): TAKASHIGE KASUYA ET AL.

It is certified that error appears in the above-identified patent and that said Letters Patent is hereby corrected as shown below:

COLUMN 15

Line 44, "water" should read --a water--.

COLUMN 17

Line 31, "acteristic" should read --acteristics--.

COLUMN 20

Line 38, "sent" should read --is sent--.
Line 48, "in" should read --in the --.

COLUMN 22

Line 55, "alkalline" should read --alkaline--;

COLUMN 25

Line 38, "power" should read --powder--.

COLUMN 27

Line 13, "further" should read --an additional--.

UNITED STATES PATENT AND TRADEMARK OFFICE

CERTIFICATE OF CORRECTION

PATENT NO. : 5,663,026

DATED : September 2, 1997

INVENTOR(S): TAKASHIGE KASUYA ET AL.

It is certified that error appears in the above-identified patent and that said Letters Patent is hereby corrected as shown below:

COLUMN 31

Line 36, "0.5-1.0 wt. %" should read --0.05-1.0 wt. %--.

COLUMN 34

Line 5, "$R_3$ and $R_3$" should read --$R_3$ and $R_4$--.

Signed and Sealed this

First Day of December, 1998

*Attest:*

*Attesting Officer*

BRUCE LEHMAN

*Commissioner of Patents and Trademarks*